US006682570B2

(12) United States Patent
Thai

(10) Patent No.: US 6,682,570 B2
(45) Date of Patent: Jan. 27, 2004

(54) BUBBLE GENERATING ASSEMBLY

(75) Inventor: Douglas Thai, Walnut, CA (US)

(73) Assignee: Arko Development Limited (HK)

( * ) Notice: Subject to any disclaimer, the term of this patent is extended or adjusted under 35 U.S.C. 154(b) by 0 days.

(21) Appl. No.: 10/444,561

(22) Filed: May 23, 2003

(65) Prior Publication Data

US 2003/0199221 A1 Oct. 23, 2003

Related U.S. Application Data

(63) Continuation-in-part of application No. 10/247,994, filed on Sep. 20, 2002, which is a continuation-in-part of application No. 10/195,816, filed on Jul. 15, 2002, which is a continuation-in-part of application No. 10/133,195, filed on Apr. 26, 2002, which is a continuation-in-part of application No. 10/099,431, filed on Mar. 15, 2002.

(51) Int. Cl.[7] ..... A63H 33/28
(52) U.S. Cl. ..... 446/15; 446/484
(58) Field of Search ..... 446/15–21, 484, 446/483, 267, 176

(56) References Cited

U.S. PATENT DOCUMENTS

| | | | | |
|---|---|---|---|---|
| 2,560,582 A | | 7/1951 | Limber | |
| 2,659,177 A | | 11/1953 | Kopf | |
| 2,974,438 A | | 3/1961 | Hopkins | |
| 3,579,898 A | | 5/1971 | Hein | |
| 3,604,144 A | | 9/1971 | Span | |
| 4,423,565 A | * | 1/1984 | Bart | 46/8 |
| 4,700,965 A | | 10/1987 | Kinberg | |
| 4,957,464 A | | 9/1990 | Perez | |
| 5,395,274 A | | 3/1995 | Myers | |
| 5,462,469 A | | 10/1995 | Lei | |
| 5,498,191 A | | 3/1996 | DeMars | |
| 5,520,564 A | | 5/1996 | DeMars | |
| 5,542,869 A | | 8/1996 | Petty | |
| 5,613,890 A | | 3/1997 | DeMars | |
| 5,879,218 A | | 3/1999 | Tao | |
| 5,975,358 A | * | 11/1999 | Zheng et al. | 222/79 |
| 6,062,935 A | | 5/2000 | Gross | |
| 6,149,486 A | | 11/2000 | Thai | |
| 6,200,184 B1 | | 3/2001 | Rich et al. | |
| 6,315,627 B1 | | 11/2001 | Thai | |
| 6,331,130 B1 | | 12/2001 | Thai | |

* cited by examiner

*Primary Examiner*—Jacob K Ackun
*Assistant Examiner*—Jamila Williams
(74) *Attorney, Agent, or Firm*—Raymond Sun

(57) ABSTRACT

A bubble generating assembly has a housing having a front opening, with a bubble generating ring and a nozzle positioned adjacent the front opening. The assembly has a first container coupled to the housing and retaining bubble solution, and a second container coupled to the housing and retaining a liquid (e.g., water). The first and second containers can be positioned next to each other. The assembly also has a first trigger, and a second trigger positioned next to the first trigger so that a user can simultaneously actuate the first and second triggers.

20 Claims, 12 Drawing Sheets

BUBBLE GENERATING ASSEMBLY

RELATED CASES

This is a continuation-in-part of co-pending Ser. No. 10/247,994, entitled "Bubble Generating Assembly", filed Sep. 20, 2002, which is a continuation-in-part of Ser. No. 10/195,816, entitled "Bubble Generating Assembly", filed Jul. 15, 2002, which is in turn a continuation-in-part of co-pending Ser. No. 10/133,195, entitled "Apparatus and Method for Delivering Bubble Solution to a Dipping Container", filed Apr. 26, 2002, which is in turn a continuation-in-part of co-pending Ser. No. 10/099,431, entitled "Apparatus and Method for Delivering Bubble Solution to a Dipping Container", filed Mar. 15, 2002, whose disclosures are incorporated by this reference as though fully set forth herein.

BACKGROUND OF THE INVENTION

1. Field of the Invention

The present invention relates to bubble toys, and in particular, to a bubble generating assembly which automatically forms a bubble film over a bubble ring without the need to dip the bubble ring into a container or a dish of bubble solution.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. Nos. 6,149,486 (Thai), 6,331,130 (Thai) and 6,200,184 (Rich et al.). The bubble rings in the bubble generating assemblies in U.S. Pat. Nos. 6,149,486 (Thai), 6,331,130 (Thai) and 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there remains a need to provide an apparatus and method for forming a film of bubble solution across a bubble ring without the need to dip the bubble ring into a dish of bubble solution.

SUMMARY OF THE DISCLOSURE

It is an object of the present invention to provide an apparatus and method for effectively forming a film of bubble solution across a bubble ring.

It is another object of the present invention to provide an apparatus and method for effectively forming a film of bubble solution across a bubble ring in a manner which minimizes spillage of the bubble solution.

It is yet another object of the present invention to provide an apparatus having a simple construction that effectively forms a film of bubble solution across a bubble ring.

It is a further object of the present invention to provide an apparatus where droplets of unused bubble solution can be returned to the bubble solution container, and having a valve that prevents bubble solution from spilling from the bubble solution container.

It is a further object of the present invention to provide an apparatus which can direct a stream of water at a plurality of formed bubbles.

The objectives of the present invention are accomplished by providing a bubble generating assembly that has a housing having a front opening, with a bubble generating ring and a nozzle positioned adjacent the front opening. The assembly has a first container coupled to the housing and retaining bubble solution, and a second container coupled to the housing and retaining a liquid (e.g., water). The first and second containers can be positioned next to each other. The assembly also has a first trigger, and a second trigger positioned next to the first trigger so that a user can simultaneously actuate the first and second triggers. A first tubing couples the interior of the first container with the ring, and a second tubing couples the interior of the second container with the nozzle. A link assembly couples the first trigger and the ring in a manner in which actuation of the first trigger causes bubbles to be formed by the ring, and a liquid generator couples the second trigger and the nozzle in a manner in which actuation of the second trigger causes liquid from the second container to be ejected from the nozzle.

DETAILED DESCRIPTION OF THE PREFERRED EMBODIMENTS

Figure 1:
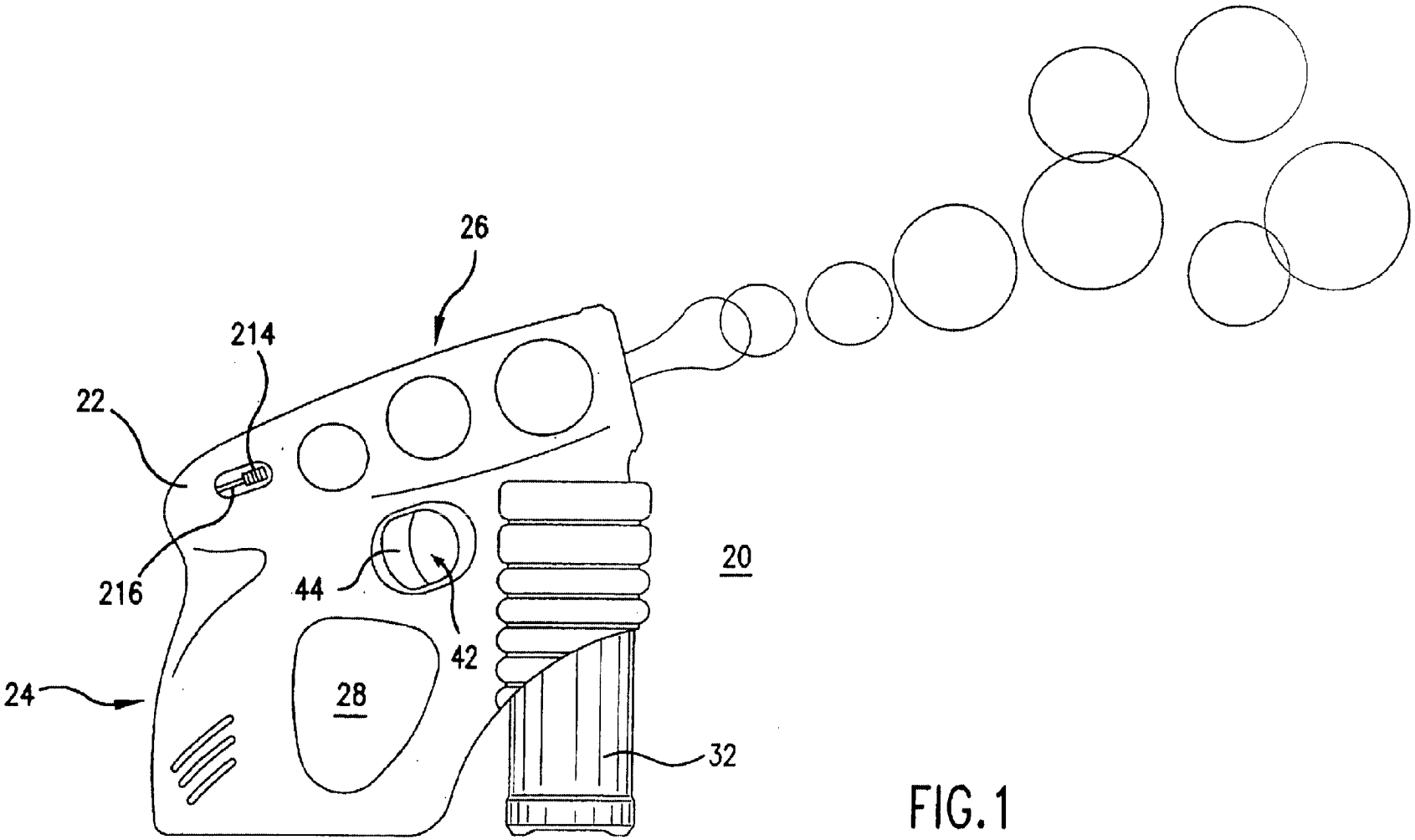
FIG. 1 is a side view of a bubble generating assembly according to one embodiment of the present invention.
Figure 2:
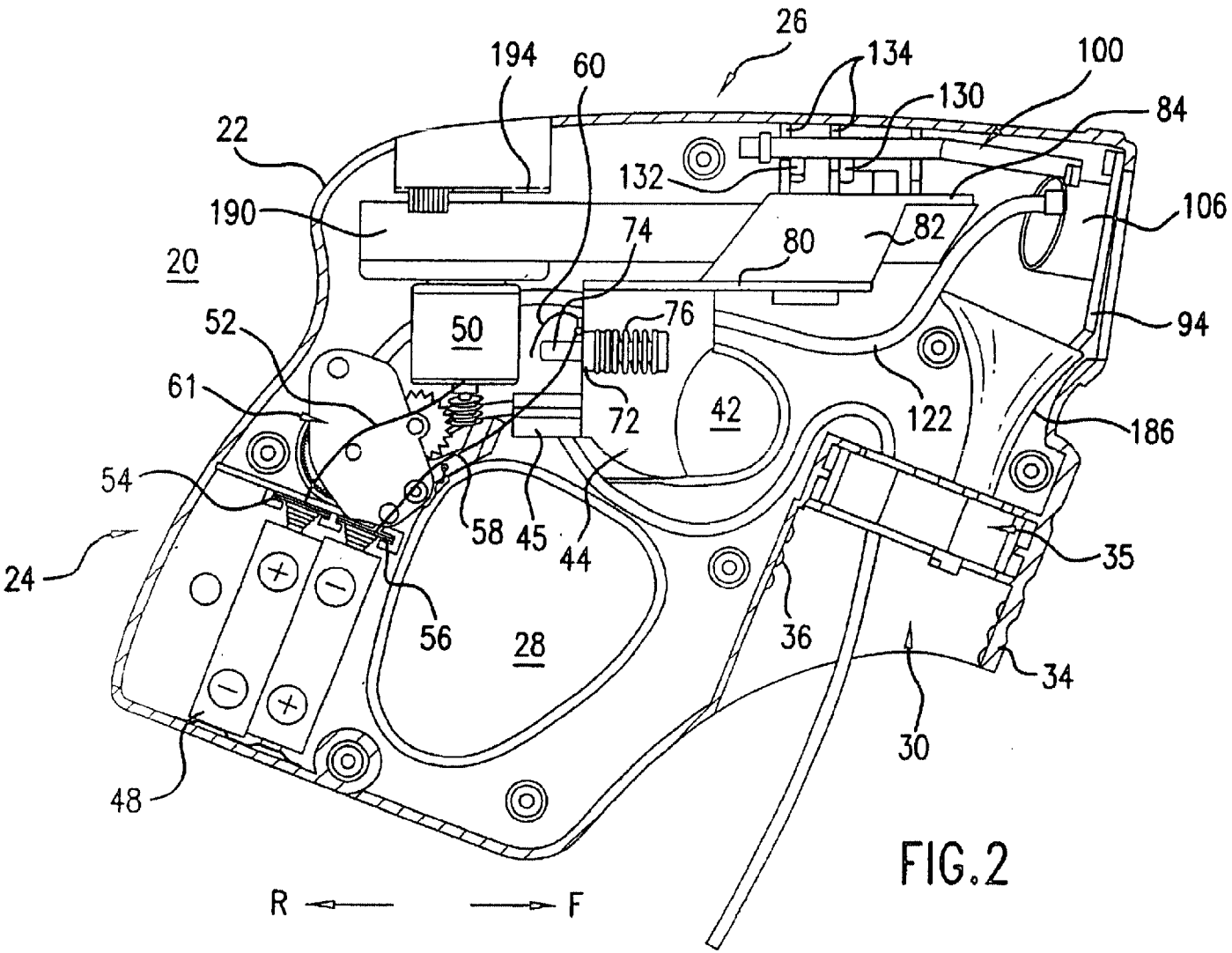
FIG. 2 is a front perspective view of the assembly of FIG. 1 shown with the bubble ring in the normal position.
Figure 3:
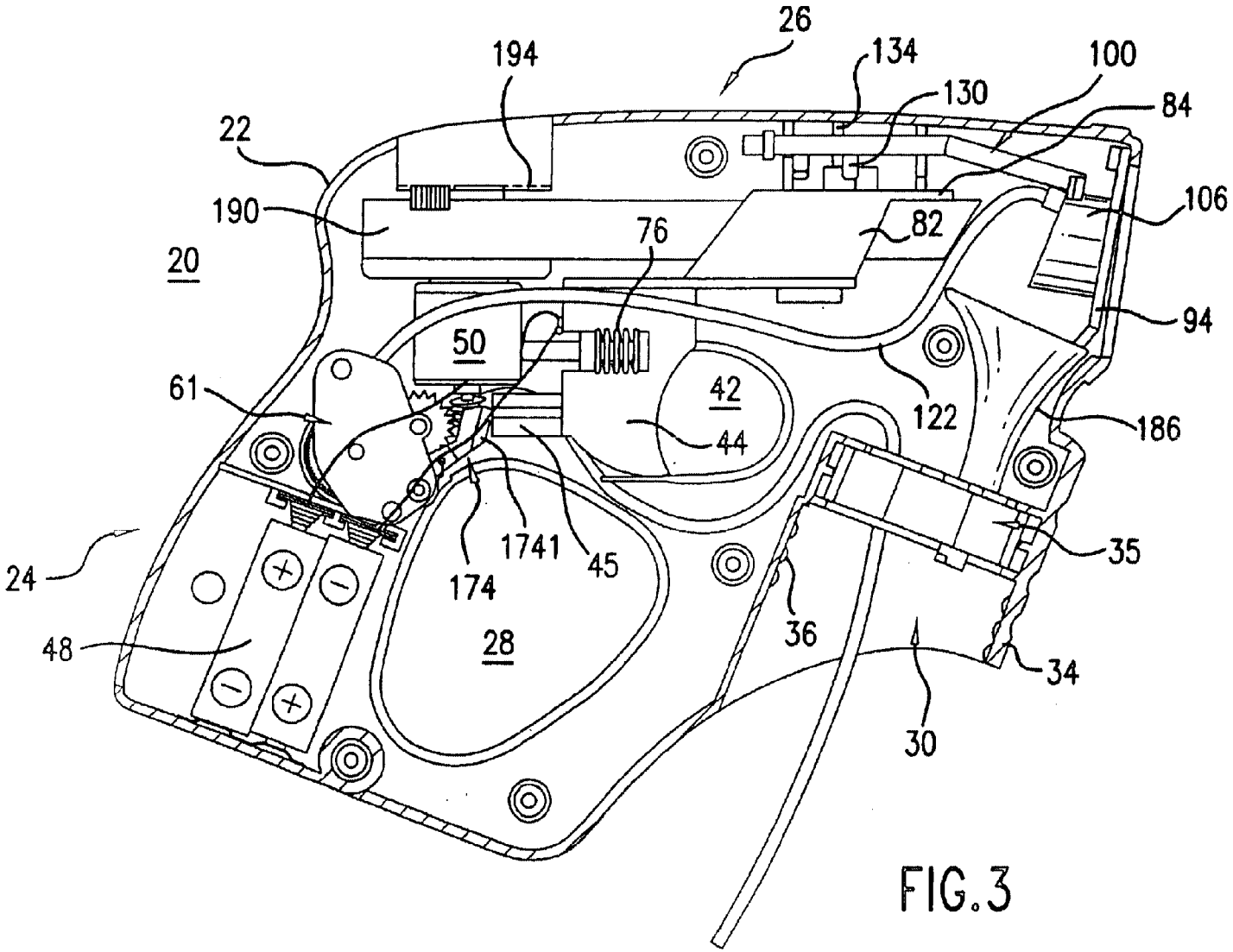
FIG. 3 is a front perspective view of the assembly of FIG. 1 shown with the bubble ring in the actuated position.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a bubble generating assembly that can, upon actuating a first trigger, generate a plurality of bubbles without the need to manually dip a bubble ring into bubble solution. The bubble generating assembly of the present invention can also, upon actuating a second trigger positioned next to the first trigger, generate a stream of liquid that can be aimed at the bubbles.

FIGS. 1–18 illustrate one embodiment of a bubble generating assembly 20 according to the present invention. The assembly 20 has a housing 22 that includes a handle section 24 and a barrel section 26. The housing 22 can be provided in the form of two symmetrical outer shells that are connected together by, for example, screws or welding or glue. These outer shells together define a hollow interior for housing the internal components of the assembly 20, as described below. The handle section 24 has an inner surface 28 that can be gripped by the hand of a user, and two triggers 42 and 44 extending from the inner surface 28 adjacent the top of the handle section 24. As described in greater detail below, a bubble trigger 44 is utilized to generate a plurality of bubbles 18, and a liquid trigger 42 is utilized to actuate a liquid generator to generate streams of a liquid 19. The two triggers 42, 44 can be positioned side-by-side so that they can be simultaneously actuated by separate fingers of the same hand of the user.

Referring to FIGS. 4, 5, 8, 9 and 15, the lower front portion of the barrel section 26 defines a first receiving space 30 that removably couples a conventional bubble solution bottle 32, and a second receiving space 31 that removably couples another bottle 33, such as a liquid-containing bottle 33. The two bottles 32, 33 can be positioned side-by-side The bubble solution bottle 32 can be provided in the form of any of the conventional bubble solution containers that are currently available in the marketplace. Each receiving space 30 and 31 is defined by a respective cap-like connector 34 and 35. Each connector 34, 35 has internal threads that are adapted to releasably engage the external threads 36 on the neck of the bottles 32, 33. In addition, a front opening 38 (see FIGS. 2 and 3) and a nozzle 39 are provided at the front of the barrel section 26, with the nozzle 39 positioned below the front opening 38.

The handle section 24 houses a power source 48 which can include at least one conventional battery. A motor 50 is secured to the housing 22 at a location that is adjacent the trigger 44. The motor 50 is electrically coupled to the power source 48 via a first wire 52. A second wire 58 couples the power source 48 to an electrical contact 60 (see FIGS. 6–9), which is adapted to releasably contact the motor 50 to form a closed electrical circuit. The electrical contact 60 is attached to the trigger 44. A solution pump system 61 (described in greater detail below) is secured to the housing 22 at a position adjacent the motor 50, and is operatively coupled to the motor 50 to deliver bubble solution from the bottle 32 to a bubble ring 106. In addition, a liquid pump system 54 (described in greater detail below) is secured inside the housing 22 and is operatively coupled to the trigger 42 to deliver liquid from the bottle 33 to the nozzle 39.

Referring to FIGS. 4–9, the trigger 44 is a generally triangular, vertical planar piece that has a horizontal bar 72 extending transversely from the trigger 44. The bar 72 can even be formed in one piece together with the trigger 44. A channel 68 is formed between two horizontal pieces 64, 66 that are secured to the housing 22, with part of the bar 72 positioned for reciprocating motion inside the channel 68, so that the bar 72 can slide back and forth along the channel 68 when the trigger 44 moves back and forth. The electrical contact 60 is secured to the diagonal surface 70 of the trigger 44. A horizontal platform 80 is carried on top of the trigger 44 in an orientation transverse to the trigger 44. A vertical piece 82 extends vertically from a side edge of the platform 80, and a shelf 84 extends horizontally in a transverse orientation from the top of the vertical piece 82. A bottom edge of the vertical piece 82 is retained inside a channel 78 and is adapted to move back and forth inside the channel 78 to guide the vertical piece 82 while the trigger 44 is moved back and forth. The shelf 84 is oriented to be parallel to the platform 80, with the vertical piece 82 perpendicular to the shelf 84 and the platform 80.

A resilient member 76 (such as a spring) has one end hooked to the front edge of the platform 80, and has an opposing edge connected to a rod 74 that is secured to the housing 22. Since the position of the rod 74 is fixed, the resilient member 76 normally biases the trigger 44 in the forward direction (see arrow F in FIGS. 4 and 7). When a user presses the trigger 44, the pressing force overcomes the natural bias of the resilient member 76 and pushes the trigger 44 in the rearward direction (see arrow R in FIGS. 4 and 7) until the electrical contact 60 engages the motor 50, closing the electrical circuit and actuating the motor 50. When the user releases his or her grip on the trigger 44, the bias of the resilient member 76 will bias the trigger 44 in the forward direction to cause the electrical contact 60 to disengage the motor 50, thereby opening the electrical circuit so that the motor 50 is not powered by the power source 48 under normal (non-operation) circumstances.

A guide bar 86 is provided on the upper surface of the shelf 84, and is operatively coupled to an actuation system that functions to cause a bubble ring 106 to experience reciprocating movement across a stationery wiping bar 94 that is fixedly secured to a collection funnel 186 at the location of the front opening 38. The guide bar 86 can be a straight bar that extends at an angle with respect to the side edges of the shelf 84. The wiping bar 94 can be a vertical bar that is positioned at about, or slightly offset from, the center of the front opening 38 (see FIGS. 2 and 3), and further reinforced by a transverse reinforcing segment 96 (secured to the housing 22) that connects the wiping bar 94 to the housing 22 so as to provide structural support to the rigidity of the wiping bar 94. Without the support provided by the reinforcing segment 96, the wiping bar 94 may break after extended contact with the bubble ring 106. In this regard, the platform 80, the vertical piece 82 and the shelf 84 also function as a link system between the trigger 44 and the actuation system so that movement of the trigger 44 is translated into movement by the actuation system.

Referring to FIGS. 4–9, the actuation system includes a pivot bar 100 and a resilient member 102. The pivot bar 100 has a front end 104 that is attached to a connecting plate 105. A bubble generating ring 106 is attached to the connecting plate 105 at an upper portion of the ring 106. The pivot bar 100 further includes a guide leg 130 and a hook leg 132 that extend vertically downwardly from the pivot bar 100. The resilient member 102 (which can be a spring) has one end that is secured to the housing 22 and an opposing end that is hooked to the hook leg 132. The guide leg 130 is positioned alongside the angled guide bar 86, and is adapted to slide back and forth along the inner surface of the guide bar 86. The pivot bar 100 is retained in a fixed horizontal position (but with the capability of pivoting) with respect to the housing 22 by a plurality of spaced-apart hangers 134 that are secured to the top of the inside of the housing 22. Each hanger 134 has an opening through which the pivot bar 100 extends, so that the pivot bar 100 can essentially pivot about the horizontal axis defined by aligning these openings in the plurality of hangers 134.

Figure 11:
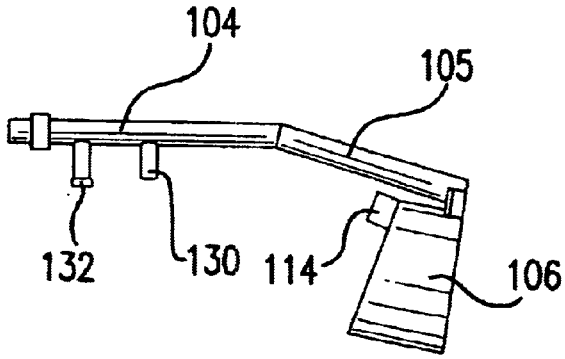
FIG. 11 is an exploded perspective view of the bubble ring of the assembly of FIG. 1.

The bubble ring 106 is adapted to be moved between a normal (non-bubble-generating) position (see FIGS. 2, 4, 6 and 8), in which the bubble ring 106 is positioned on one side (e.g., near the three o'clock position) of the front opening 38, to a bubble generating (actuated) position (see FIGS. 3, 5, 7 and 9), where the bubble ring 106 is positioned at the other side (e.g., near the nine o'clock position) of the front opening 38. The structure of the bubble ring 106 is illustrated in FIG. 11. The ring 106 has an annular base piece 108 that has a cylindrical wall 110 extending therein to define an annular chamber 112 therein. An opening 114 is provided in the base piece 108. The ring 106 also has an annular cover piece 116 that fits into the annular chamber 112 of the base piece 108. A plurality of outlets 118 can be provided along the inner annular surface, and/or the front surface 120, of the cover piece 116. A tubing 122 (see FIGS. 4 and 5) is attached to the opening 114 of the ring 106 to deliver bubble solution from the solution bottle 32 via the tubing 122 into the chamber 112 of the ring 106. The bubble solution from the chamber 112 can then leak out of the outlets 118 onto the front surface 120 of the ring 106.

Referring now to FIGS. 4, 5,10 and 12–14, the assembly 20 includes a pump system 61 that functions to pump the bubble solution from the solution bottle 32 to the bubble ring 106. The pump system includes the motor 50, the tubing 122, a guide wall 150, and a gear system that functions to draw bubble solution through the tubing 122. The gear system includes a motor gear 152 that is rotatably coupled to a shaft 154 of the motor 50, a first gear housing plate 156, a first gear 158, a second gear 160, a resilient element 162 (such as a spring), two pressure rollers 164, 166, a shaft 168, a slider 174, and a second gear housing plate 175. The motor gear 152 has teeth that are engaged with the teeth of the first gear 158. The first gear 158 is rotatably coupled to the gear housing plates 156 and 175 via a shaft 159, and has teeth that are engaged with the teeth of the second gear 160. The opposing ends of the shaft 159 are rotatably secured in openings 151 and 153 in the gear housing plates 156 and 175, respectively. The second gear 160 rotates about an axis defined by the shaft 168, and the resilient element 162 is carried on the shaft 168 between the second gear 160 and a circular plate 155. The shaft 168 extends through an opening in the plate 155, through the second gear 160 and is rotatably secured to openings 177 and 179 in the gear housing plates 156 and 175, respectively. As a result, the second gear 160 can rotate about the shaft 168 that is secured to the gear housing plates 156 and 175. Each pressure roller 164, 166 has a shaft 172 and a bulbous section 170 that has a larger diameter than the diameter of the shaft 172. Each shaft 172 is secured to openings 171 that are spaced-apart along the periphery of the circular plate 155.

Figure 12:
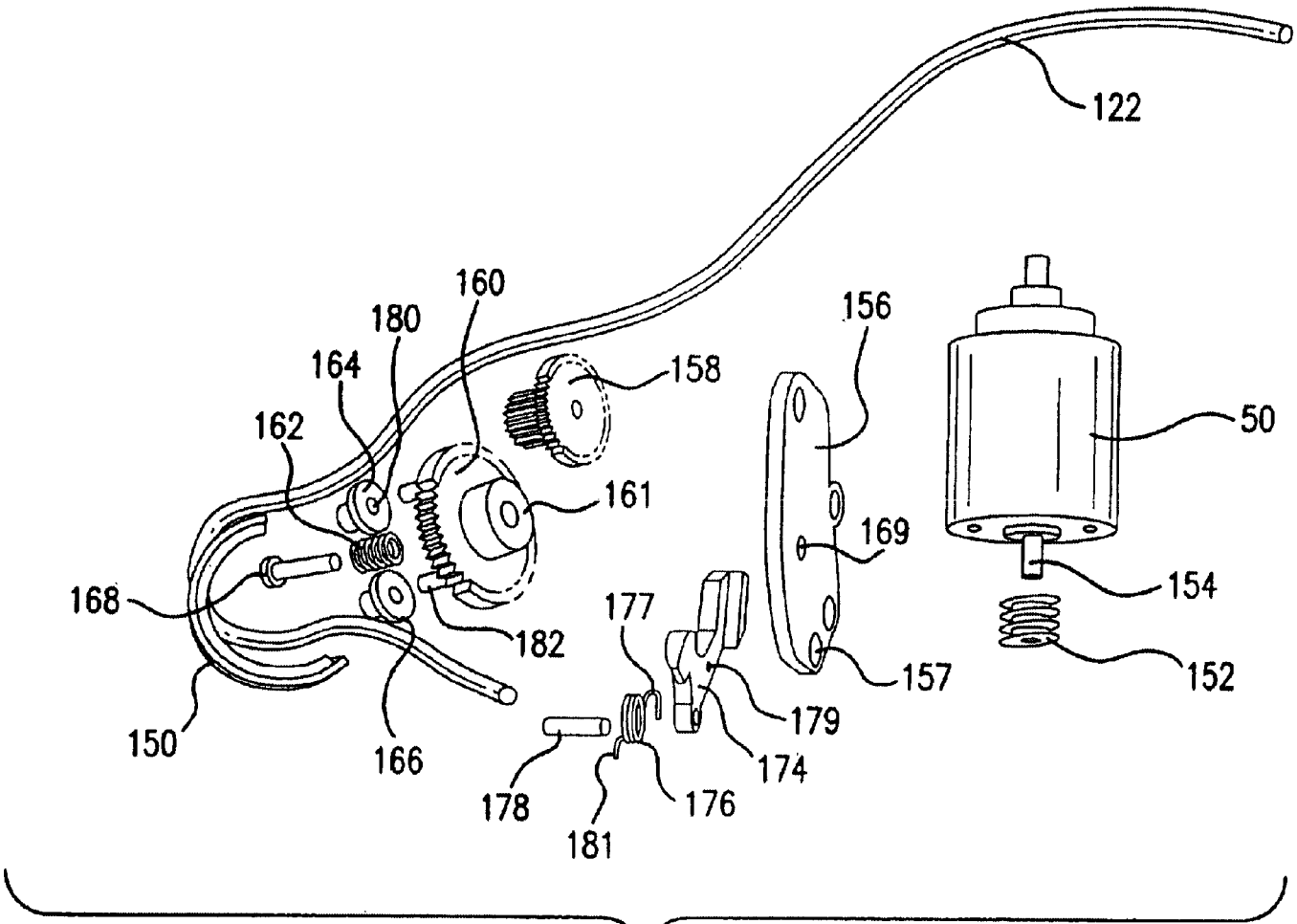
FIG. 12 is an isolated top plan view illustrating the relationship between the pressure rollers and the tubing when the assembly of FIG. 1 is in the normal non-bubble-generating condition.
Figure 13:
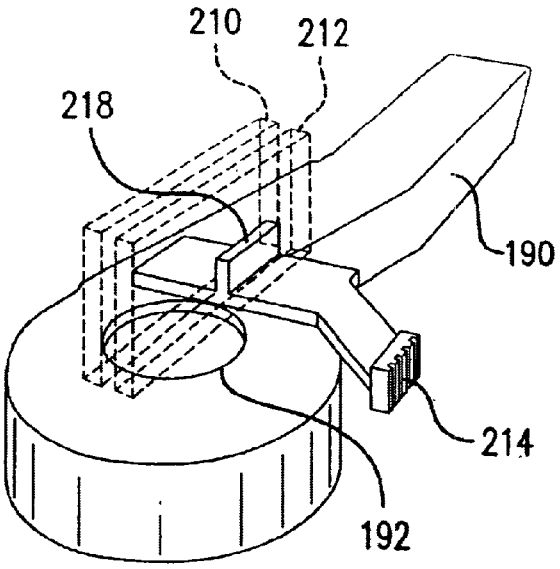
FIG. 13 is an isolated top plan view illustrating the relationship between the pressure rollers and the tube when the assembly of FIG. 1 is in the bubble-generating position.
Figure 14:
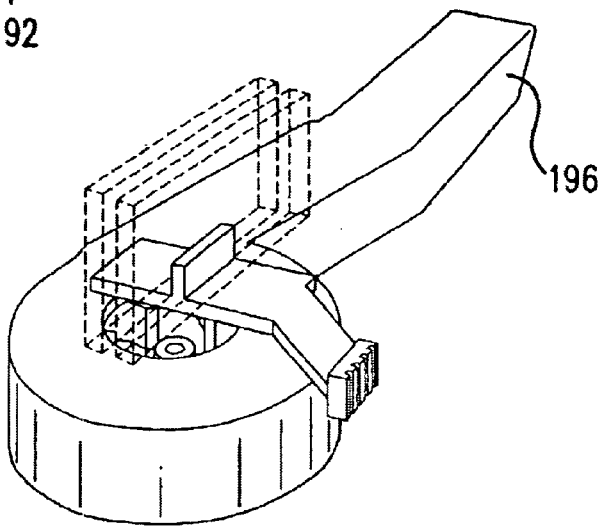
FIG. 14 is a perspective view of the slider of the pump system of FIG. 10.
Figure 15:
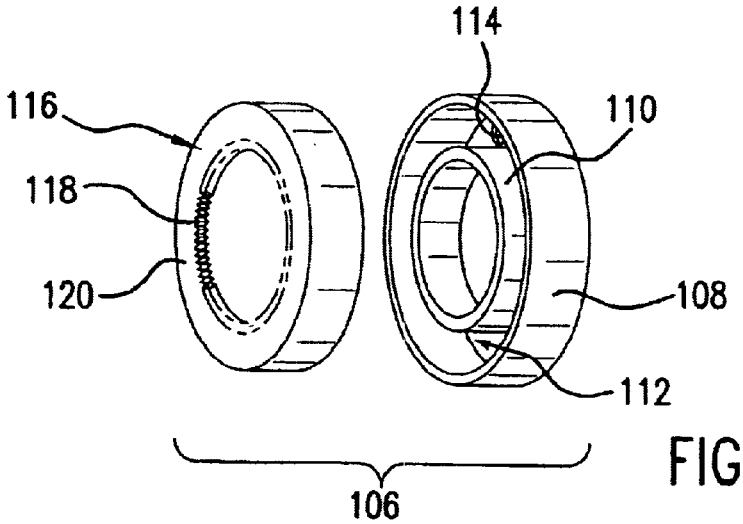
FIG. 15 is a side perspective view of one half of the housing of the assembly of FIG. 1.
Figure 19:
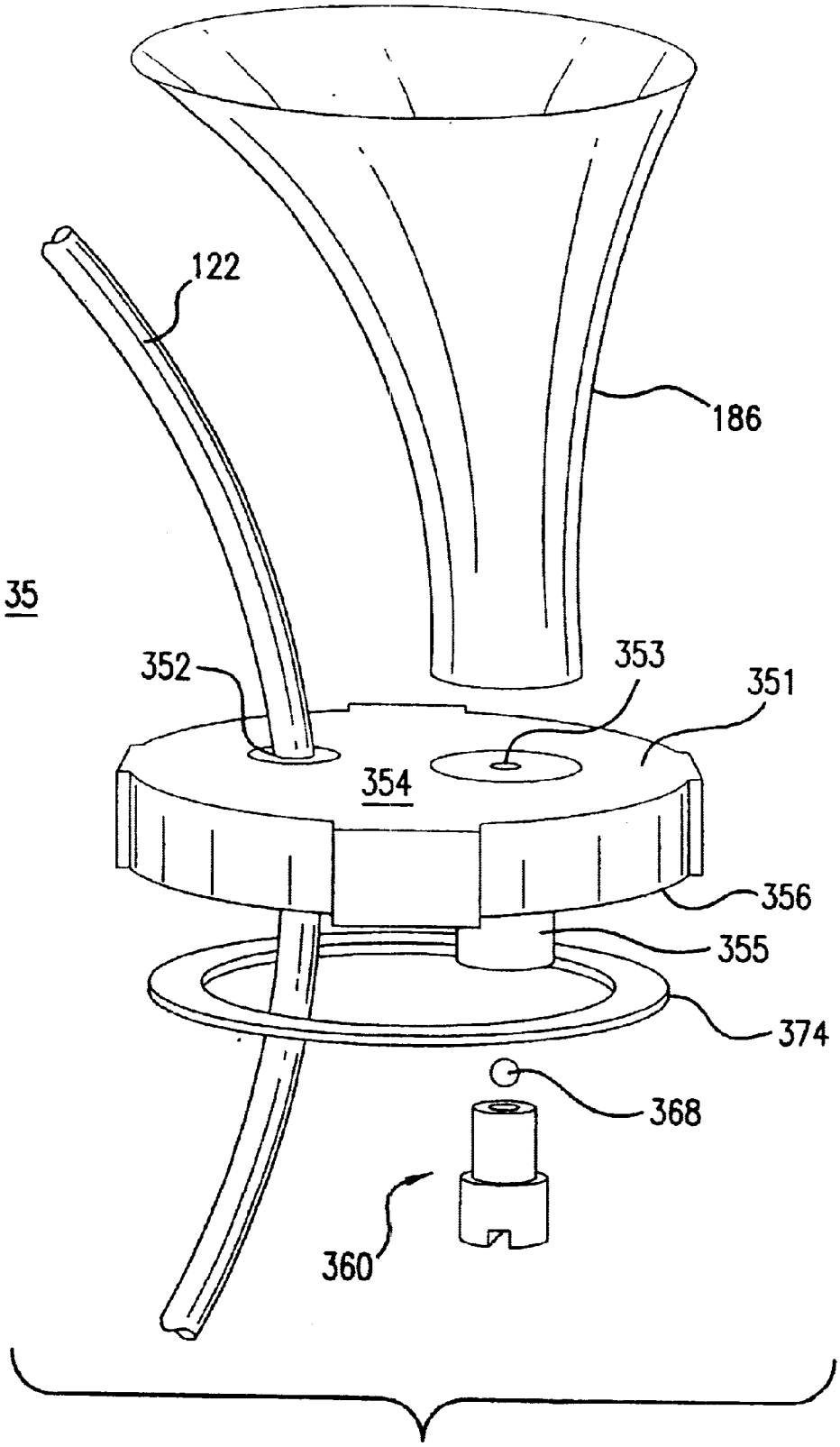
FIG. 19 is an isolated side plan view illustrating the operation of the solution pump system when the assembly of FIG. 1 is in the normal non-bubble-generating condition.
Figure 20:
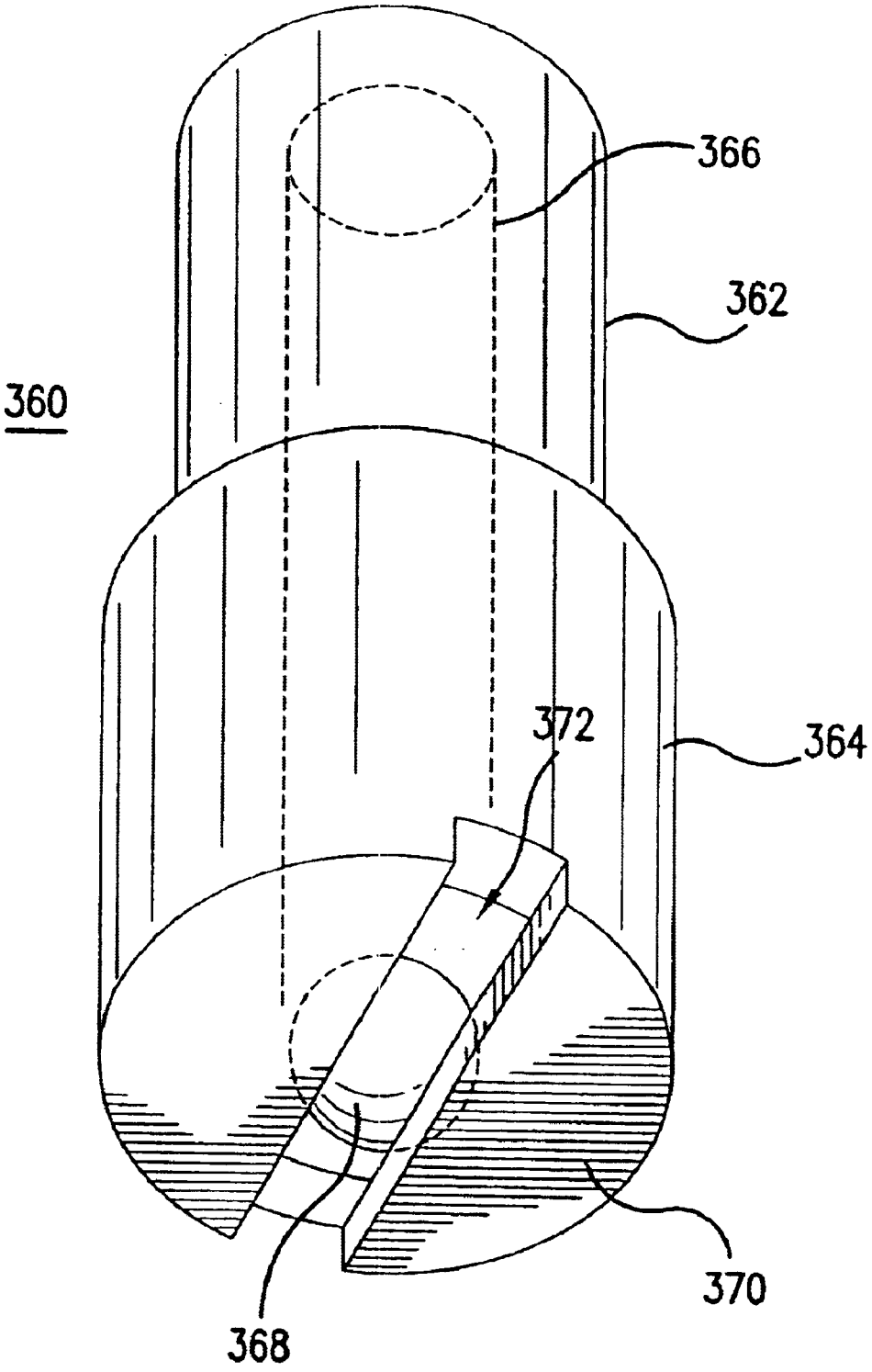
FIG. 20 is an isolated side plan view illustrating the operation of the solution pump system when the assembly of FIG. 1 is in the bubble-generating position.
Figure 1:
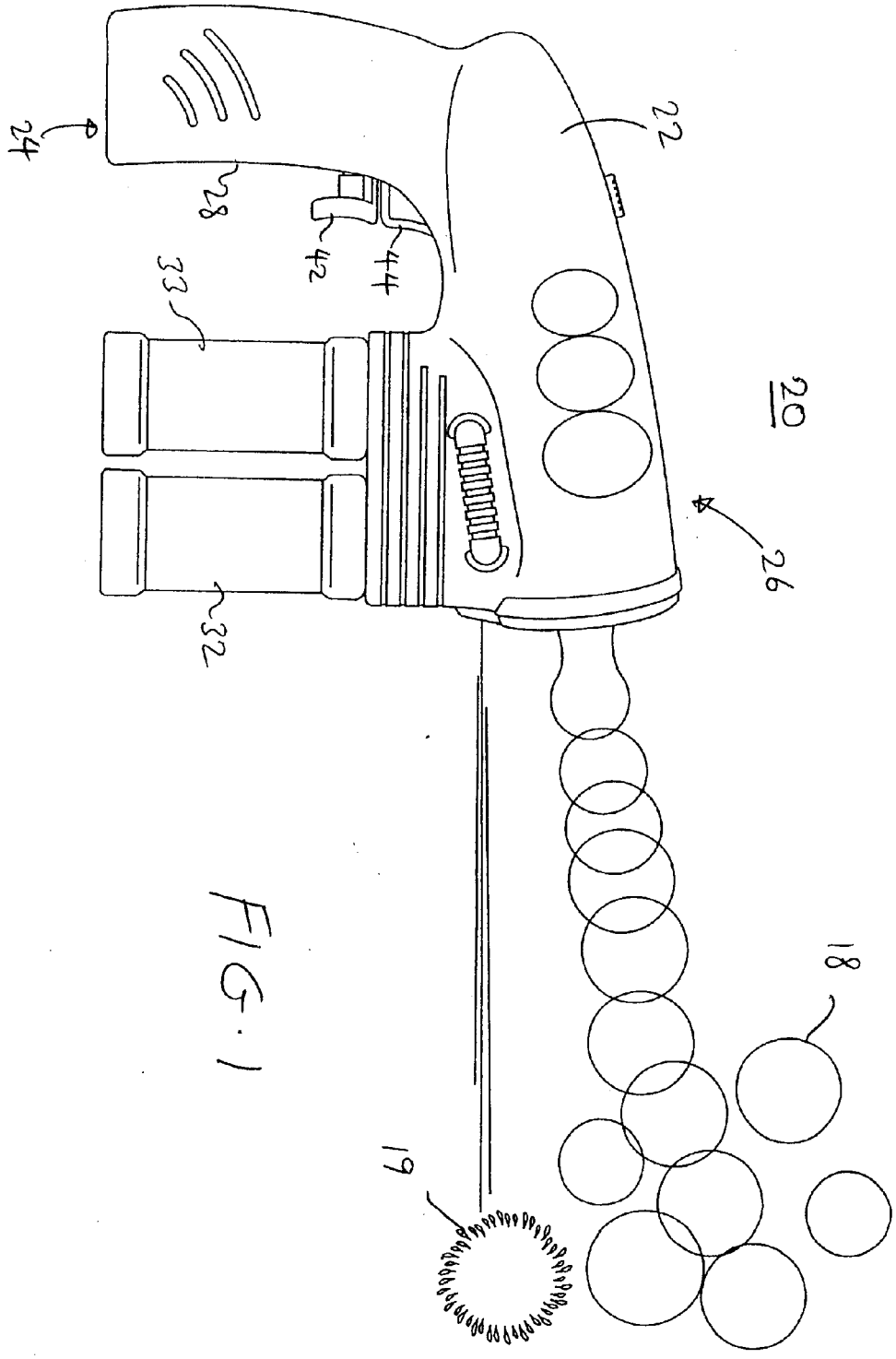
Figure 2:
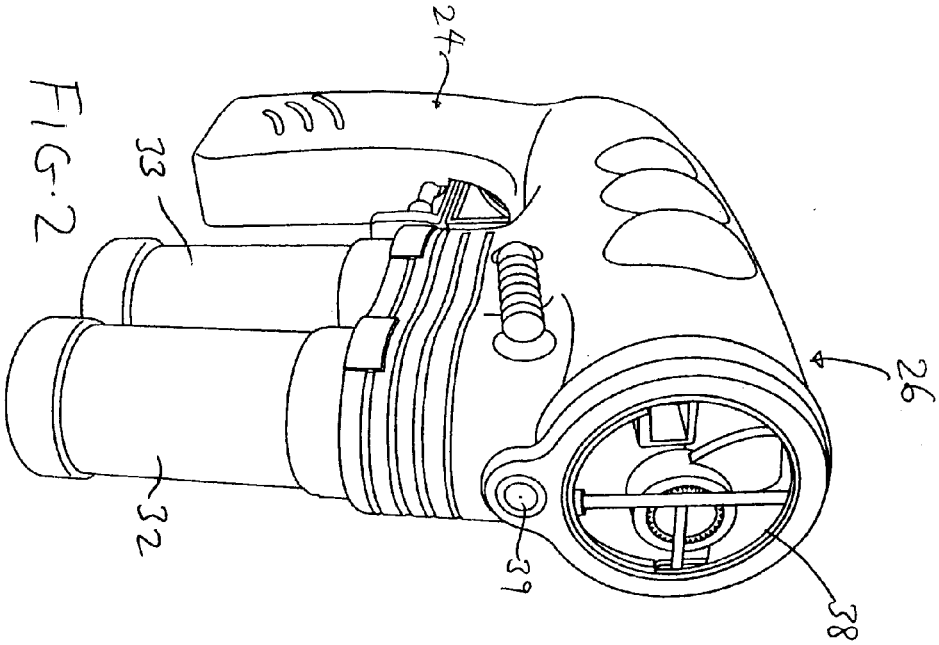
Figure 3:
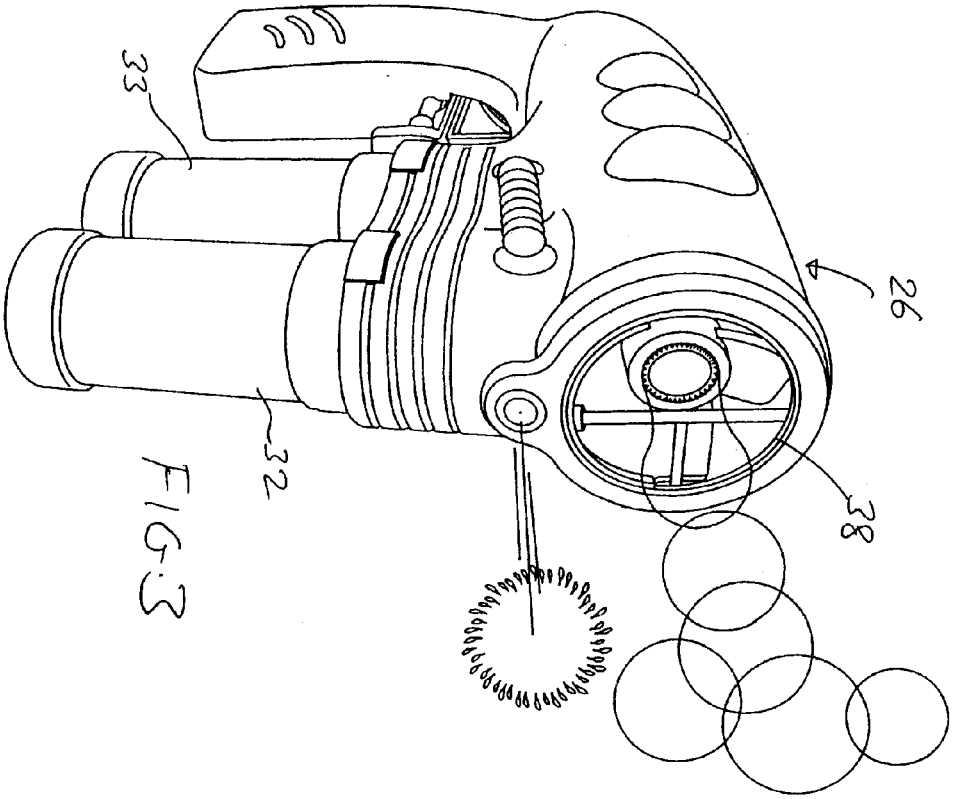
Figure 5:
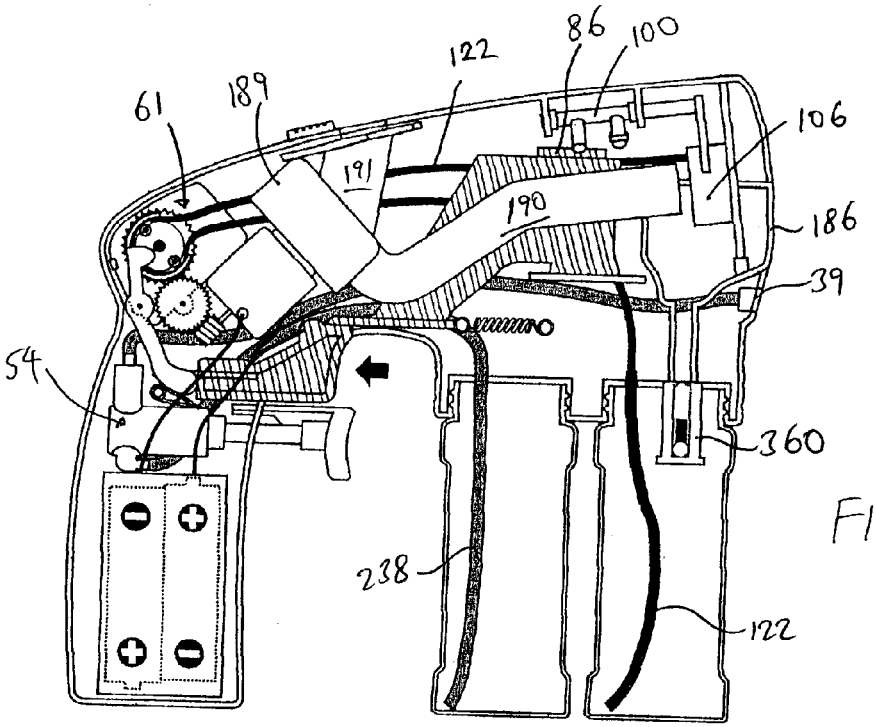
Figure 4:
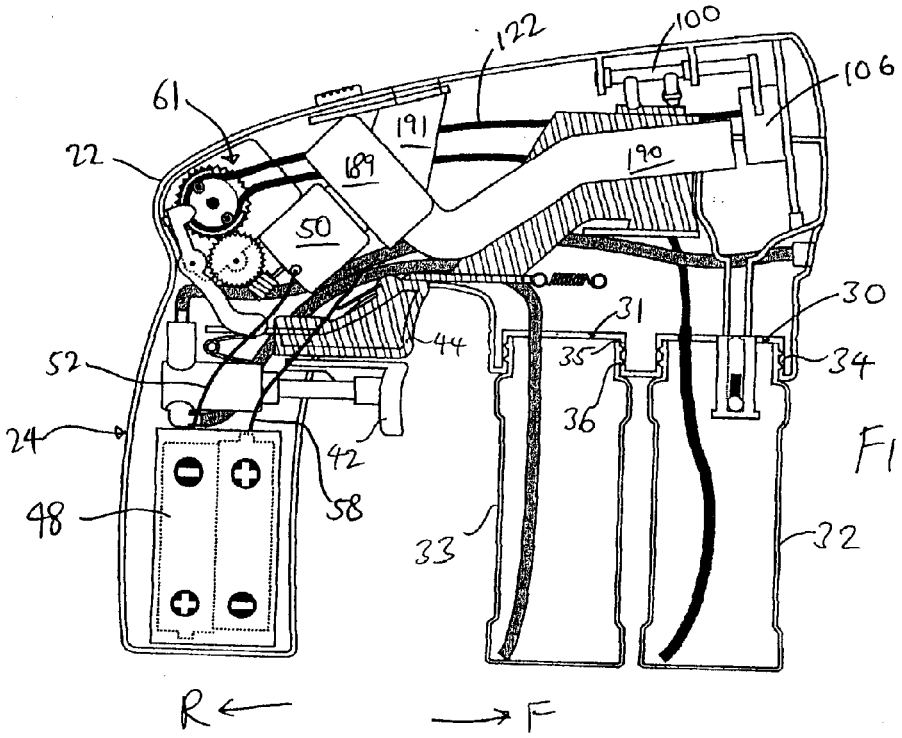
Figure 6:
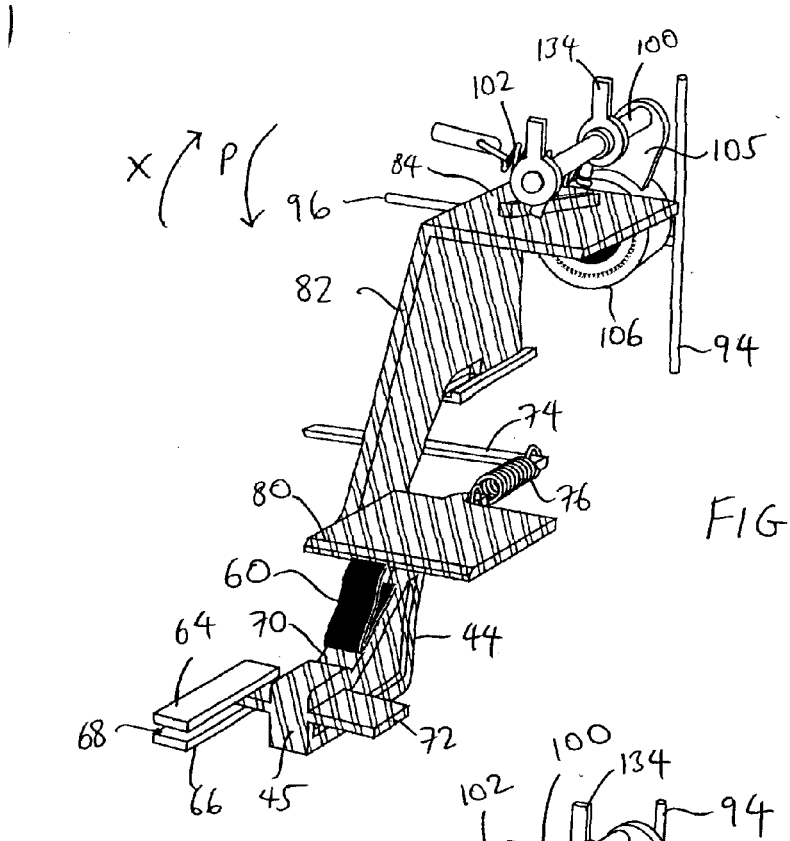
Figure 7:
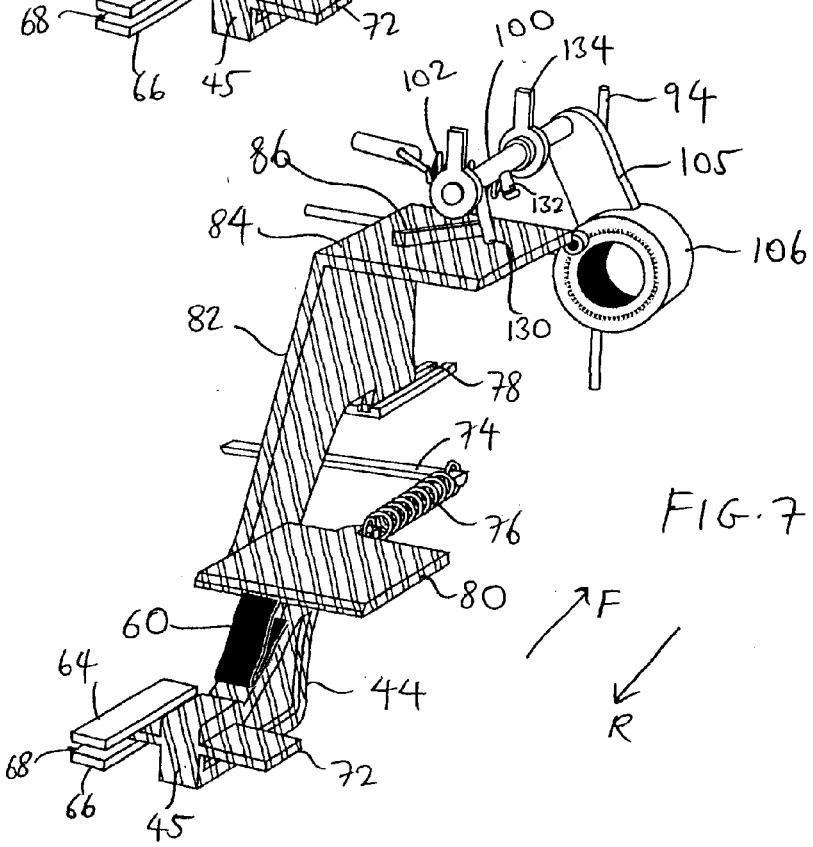
Figure 8:
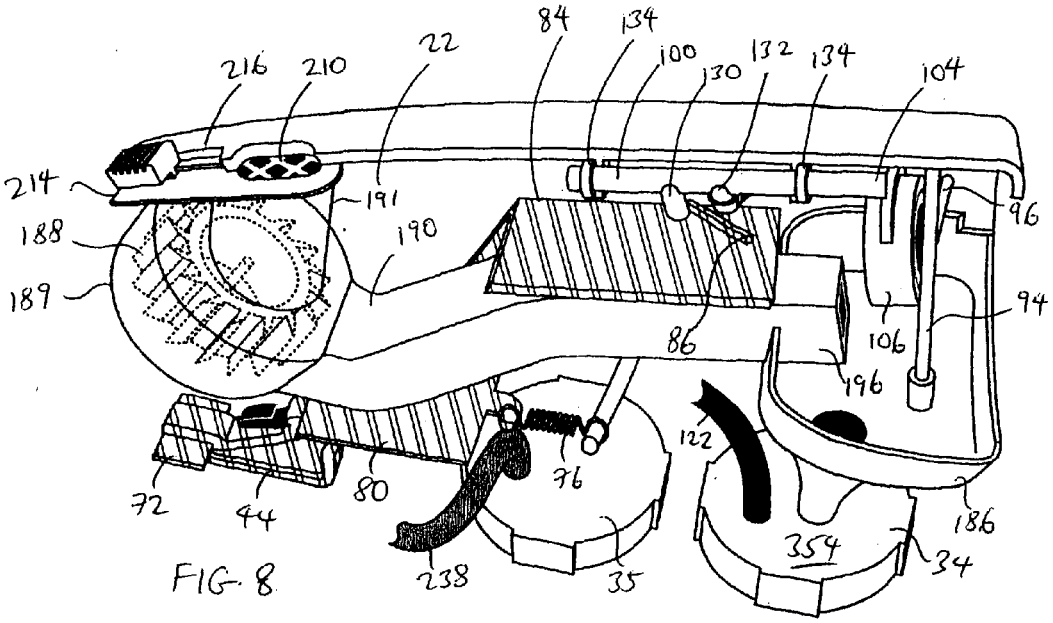
Figure 9:
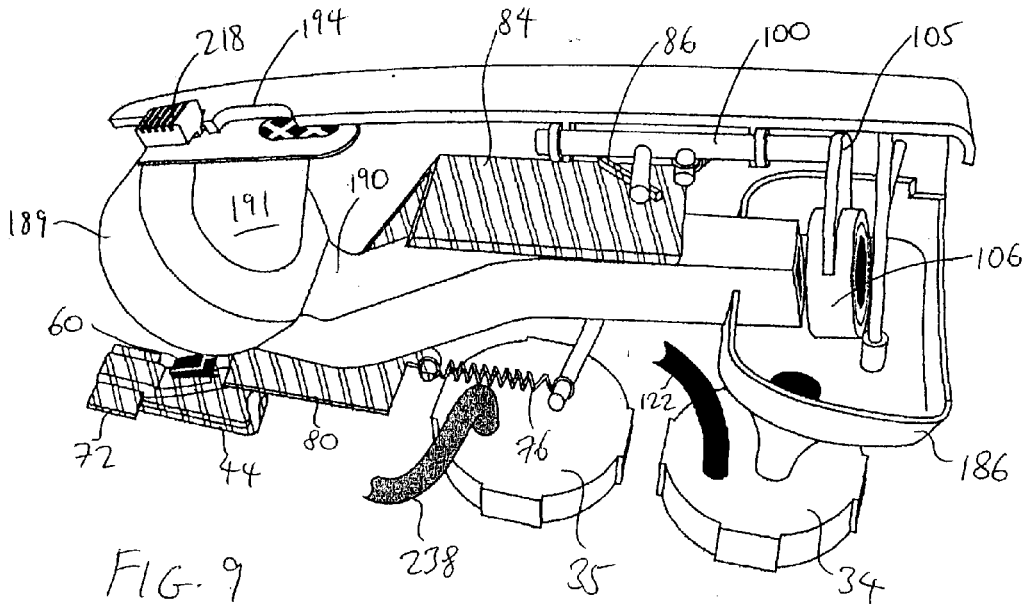
Figure 10:
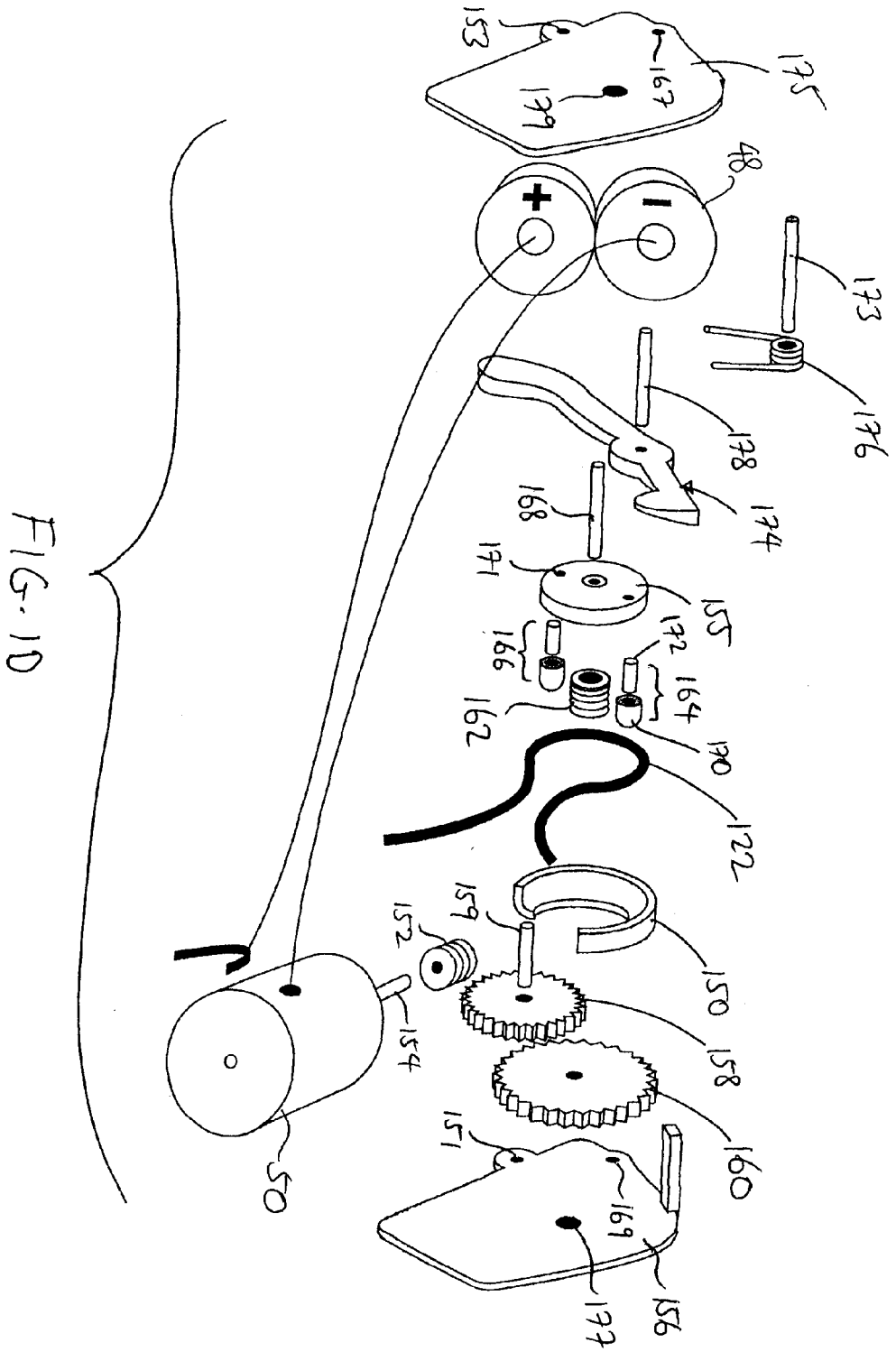
Figure 11:
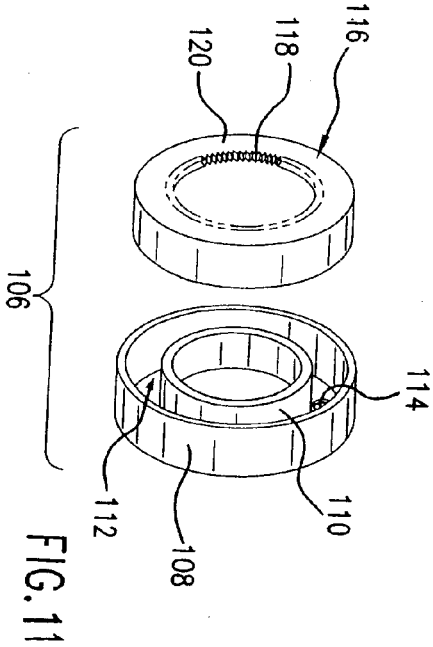
Figure 13:
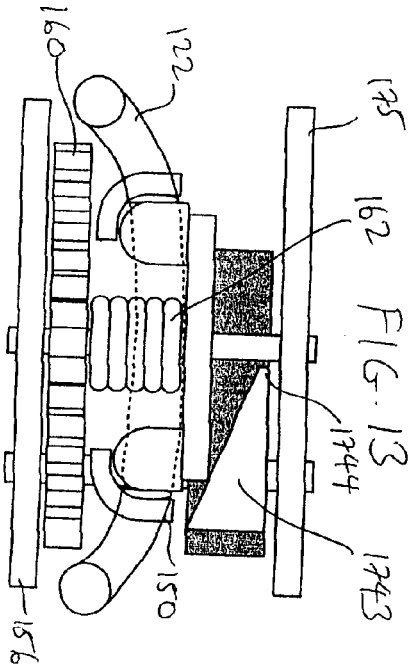
Figure 14:
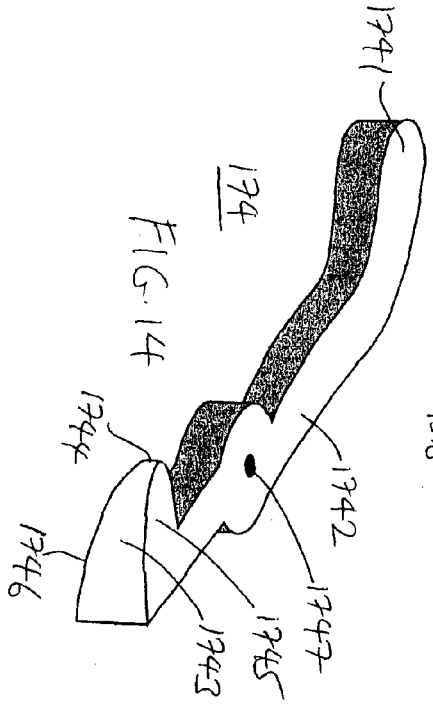
Figure 12:
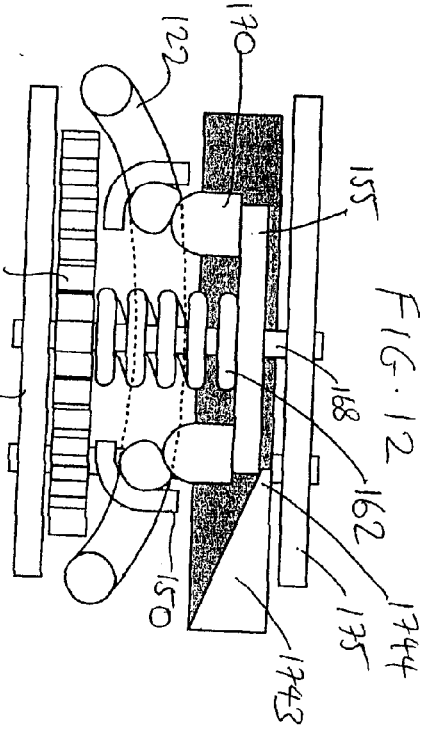
Figure 15:
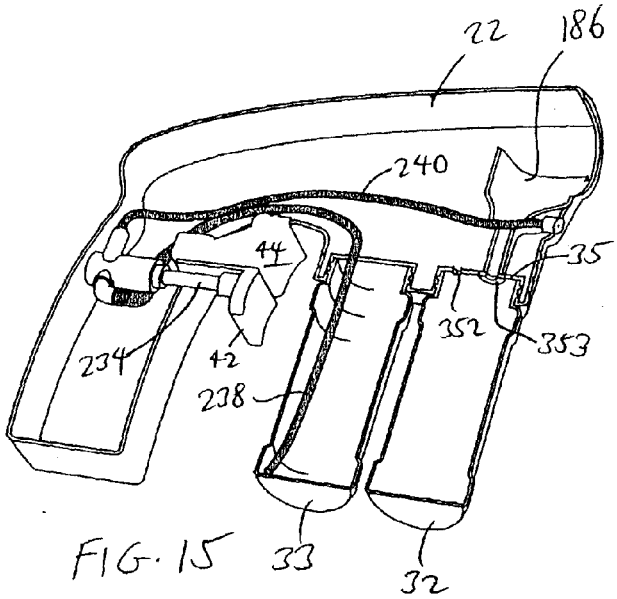
Figure 16:
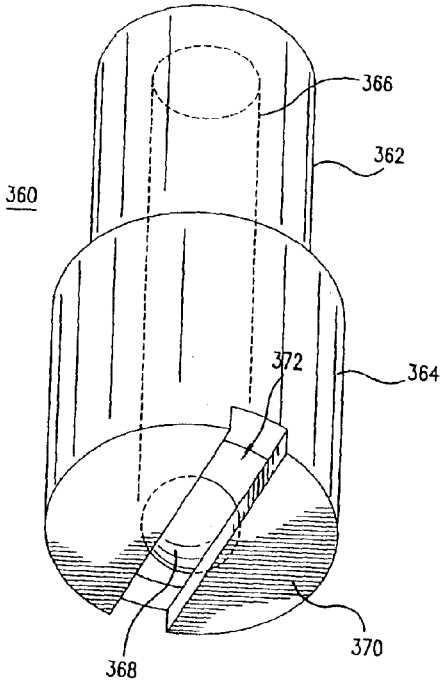
Figure 18:
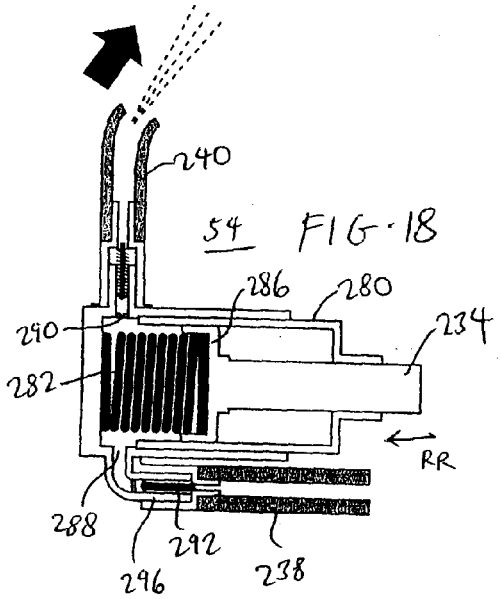
Figure 17:
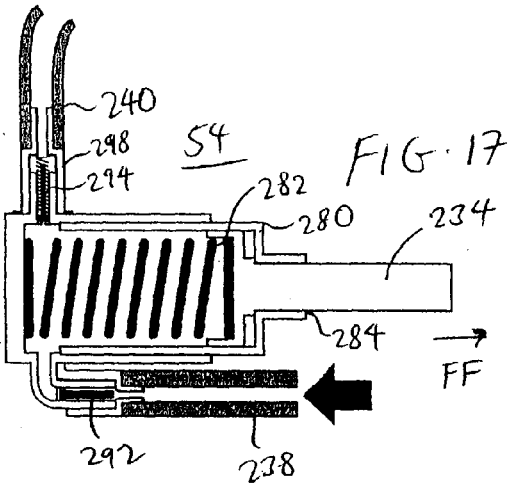
Figure 19:
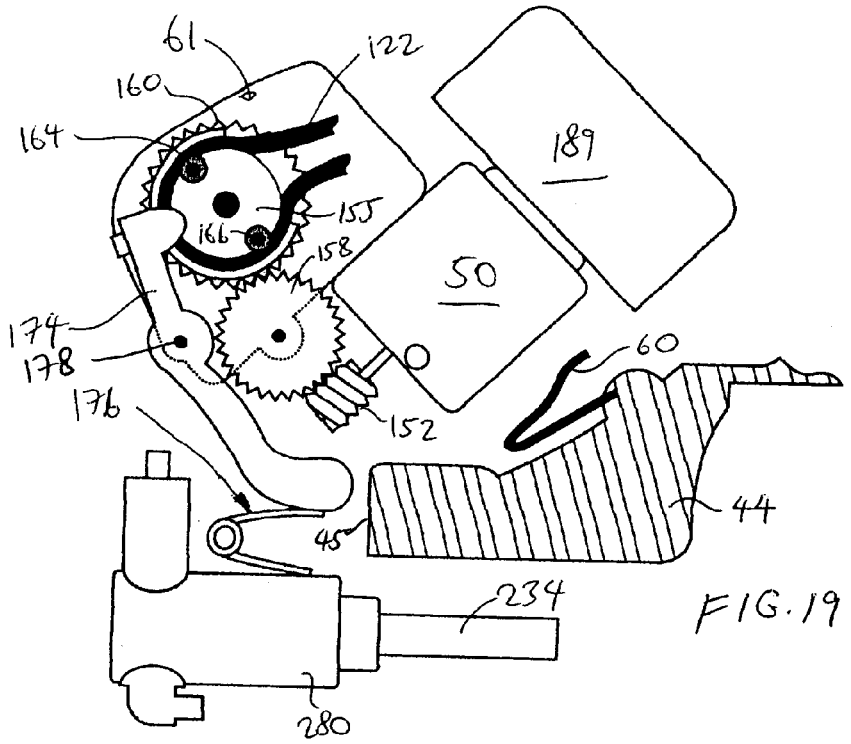
Figure 20:
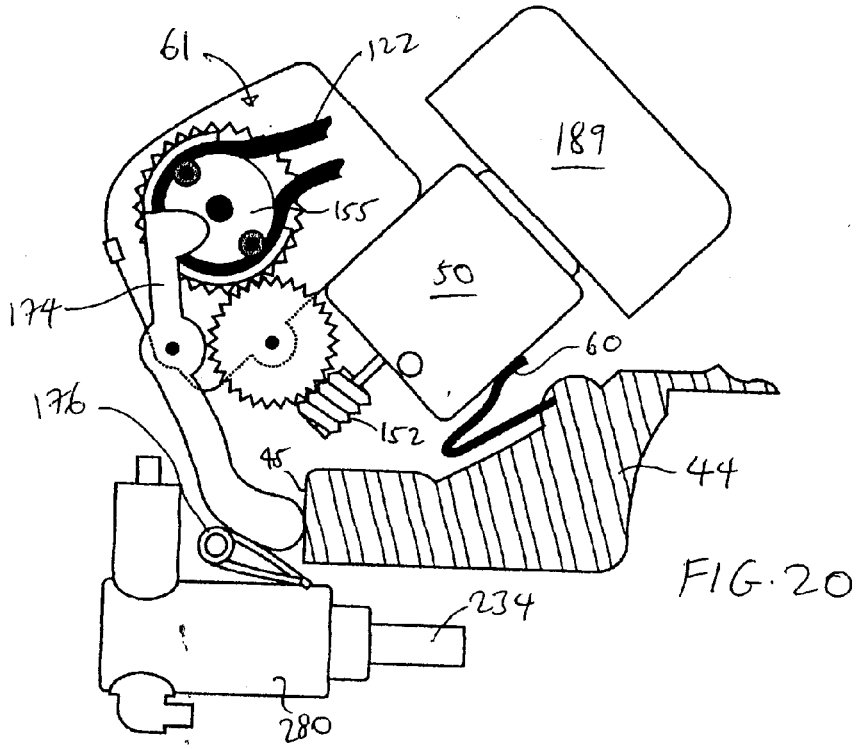

The slider 174 is best illustrated in FIGS. 12–14. The slider 174 has a body section 1742 with an angled front portion 1741 that is adapted to be abutted by a pushing end surface 45 of the trigger 44 (see FIGS. 6 and 7). A tapered piece 1743 extends from the rear of the body section 1742. The thickness of the tapered piece 1743 gradually decreases from the body section 1742 until it reaches its smallest thickness at its terminal tip 1744. In particular, this decreasing thickness (see FIGS. 12–14) is accomplished by providing a flat top surface 1745 and a bottom surface 1746 that gradually angles towards the top surface 1745 to reduce the thickness of the curved piece 1743. An opening 1747 is provided at about the center of the body section 1742. A shaft 178 extends through the opening 1747 and has one end secured to the opening 169 on the first gear housing plate 156, and has the other end secured to the opening 167 on the second gear housing plate 175. In addition, a resilient member 176 (e.g., a spring) is pivotably secured to the housing 22 by a pin 173, and has one end contacting the front portion 1741 of the slider 174, and an opposite end contacting the pump chamber 280 of the pump 54. See FIGS. 19 and 20. Thus, the slider 174 can be pivoted with respect to the gear housing plate 156 about an axis defined by the shaft 178, with the resilient member 176 functioning to normally bias the slider 174 in a counter-clockwise direction (as viewed from the orientation in FIG. 19) to a first normal position that is shown in FIGS. 12 and 19. In this normal position, the plate 155 is positioned adjacent the terminal tip 1744 of the slider 174, where the thickness of the curved piece 1743 is smallest. In addition, the tubing 122 extends from the interior of the solution bottle 32, through the connector 34, into the housing 22, and passes through a path (that is defined by the pressure rollers 164, 166, and the guide wall 150) that leads to the opening 114 of the bubble ring 106. At the location of the pressure rollers 164, 166 and the guide wall 150, the tubing 122 is positioned between the bulbous section 170 of the pressure rollers 164, 166 and the guide wall 150.

The pump system 61 operates in the following manner. When the motor 50 is actuated, the motor gear 152 will rotate, thereby causing the first and second gears 158 and 160 to rotate as well. As the second gear 160 rotates, the pressure rollers 164, 166 will also rotate because they are carried by the plate 155 which rotates with the second gear 160 because both the plate 155 and the second gear 160 are carried by the shaft 168. As the pressure rollers 164, 166 rotate, they will apply selected pressure on different parts of the tubing 122 in the manner described below to draw bubble solution from the solution bottle 32 to the bubble ring 106.

A fan system is illustrated in FIGS. 4, 5, 8 and 9. An air generator 188 (such as a fan) is provided inside a fan housing 189, and is rotatably coupled to the motor 50. An air inlet tube 191 extends from an opening 194 at the top of the housing 22 and is connected to the fan housing 189. A wind tunnel 190 is positioned in the barrel section 26, and is connected to the fan housing 189. Thus, air from the outside can be directed through the opening 194, through the tube 191 into the fan housing 189, and then through the wind tunnel 190 so that the air generator 188 can direct the air as a stream of air through the length of the wind tunnel 190 to the front end 196 of the wind tunnel 190. The front end 196 of the wind tunnel 190 has an opening, and is positioned adjacent the bubble ring 106 so that the stream of air can be blown against the bubble ring 106 in the bubble generating position to generate bubbles.

The fan system is provided with an air control system that regulates the amount of air being introduced into the housing 22 from the outside. The air control system includes a slide member 214 that adjustably covers portions of the opening 194 to regulate the amount of air that is delivered from the external environment into the air inlet tube 191. The slide member 214 has a button 218 that extends through a slot 216 in the housing 22 to the exterior so that the user can adjust the air control system by sliding the button 218 (and hence the slide member 214) back and forth in the slot 216. An opening 210 is provided on the slide member 214 and is adapted to be aligned with the opening 194. For example, when the slide member 214 is adjusted so that the opening 210 in the slide member 214 is completely aligned with the opening 194 in the housing 194 (i.e., to the rear-most position as viewed in the orientation of FIG. 1), the maximum amount of external air is allowed to enter and flow through the openings 194 and 210, and into the air inlet tube 191 (see FIG. 8). On the other hand, as the slide member 214 is slid forwardly along the slot 216 (as viewed from the orientation of FIG. 1), the slide member 214 will cover varying portions of the opening 194 (see FIG. 9) so that decreasing amounts of external air are allowed to enter and flow through the openings 194 and 210, and into the air inlet tube 191. When new batteries (i.e., the power supply 48) are used, the air generator 188 will be stronger so that less external air is needed to generate a consistent stream of air to be directed through the wind tunnel 190 at the bubble ring 106. On the other hand, when the batteries get older, the air generator 188 will become progressively weaker so that more external air is needed to generate a consistent stream of air to be directed through the wind tunnel 190 at the bubble ring 106. Thus, depending on the strength of the power supply 48 and the air generator 188, the user can adjust the amount of external air introduced through the openings 194 and 210 into the fan housing 189 by blocking varying portions of the opening 194.

Figure 5:
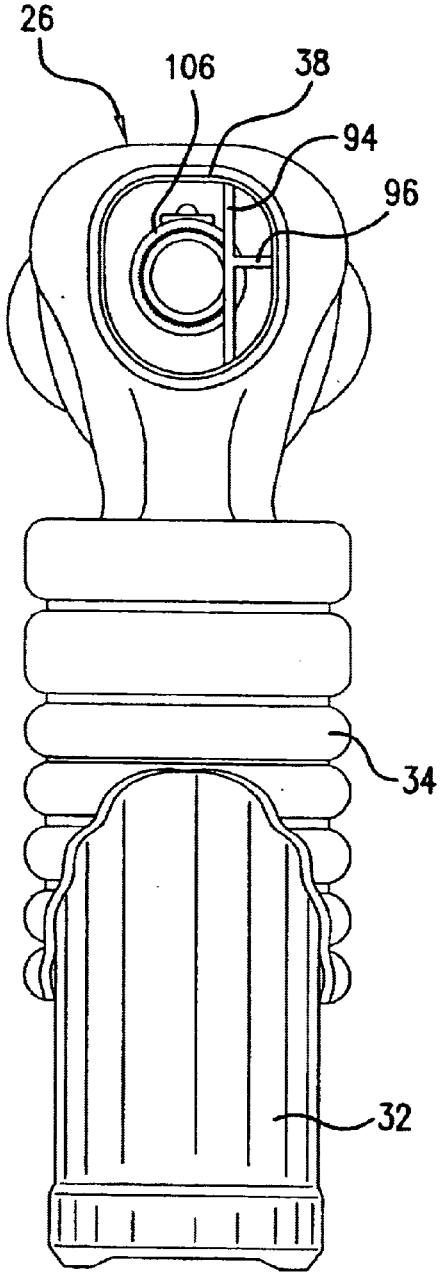
FIG. 5 is a cross-sectional view of the assembly of FIG. 1 shown with the bubble trigger being actuated.
Figure 4:
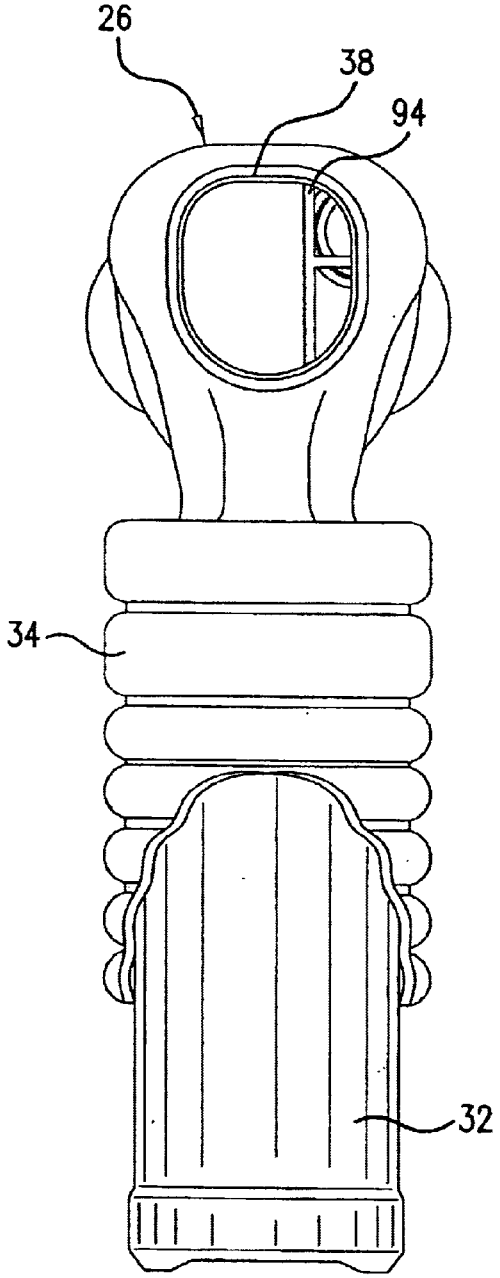
FIG. 4 is a cross-sectional view of the assembly of FIG. 1 shown with the bubble trigger in the normal position.
Figure 6:
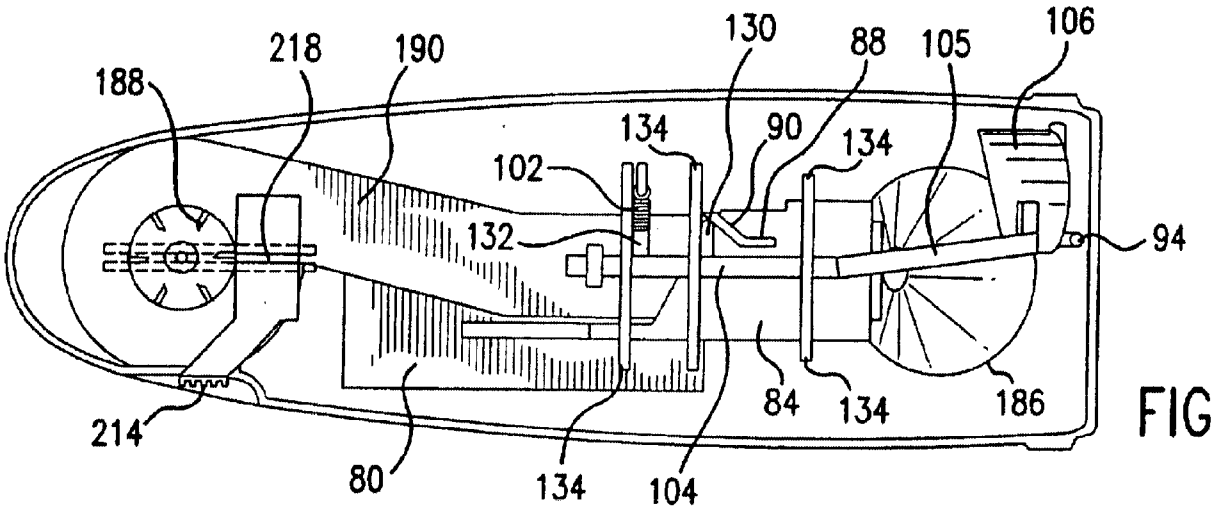
FIG. 6 is an isolated and enlarged perspective view of the link system of the assembly of FIG. 1 shown with the bubble ring in the normal position.
Figure 7:
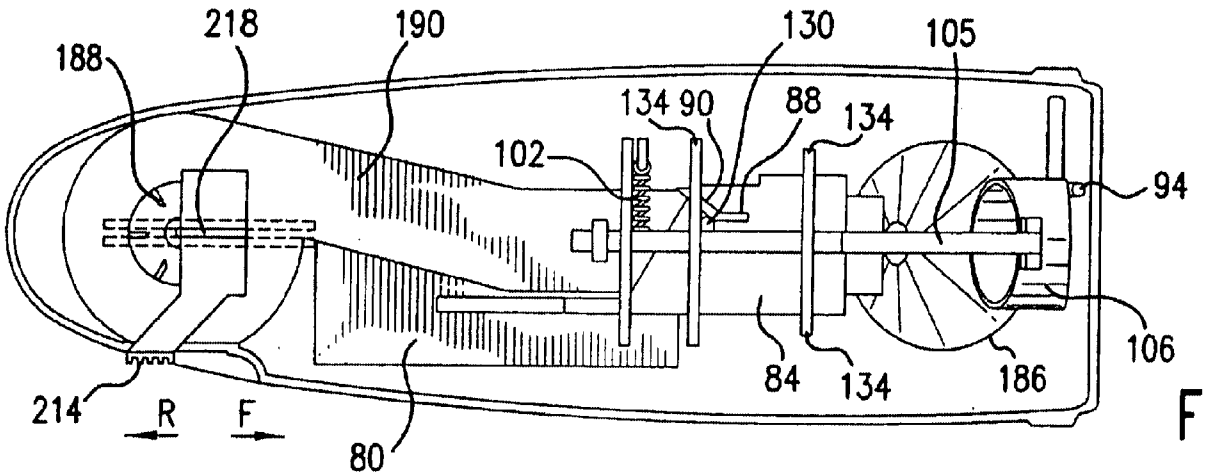
FIG. 7 is an isolated and enlarged perspective view of the link system of the assembly of FIG. 1 shown with the bubble ring in the actuated position.
Figure 9:
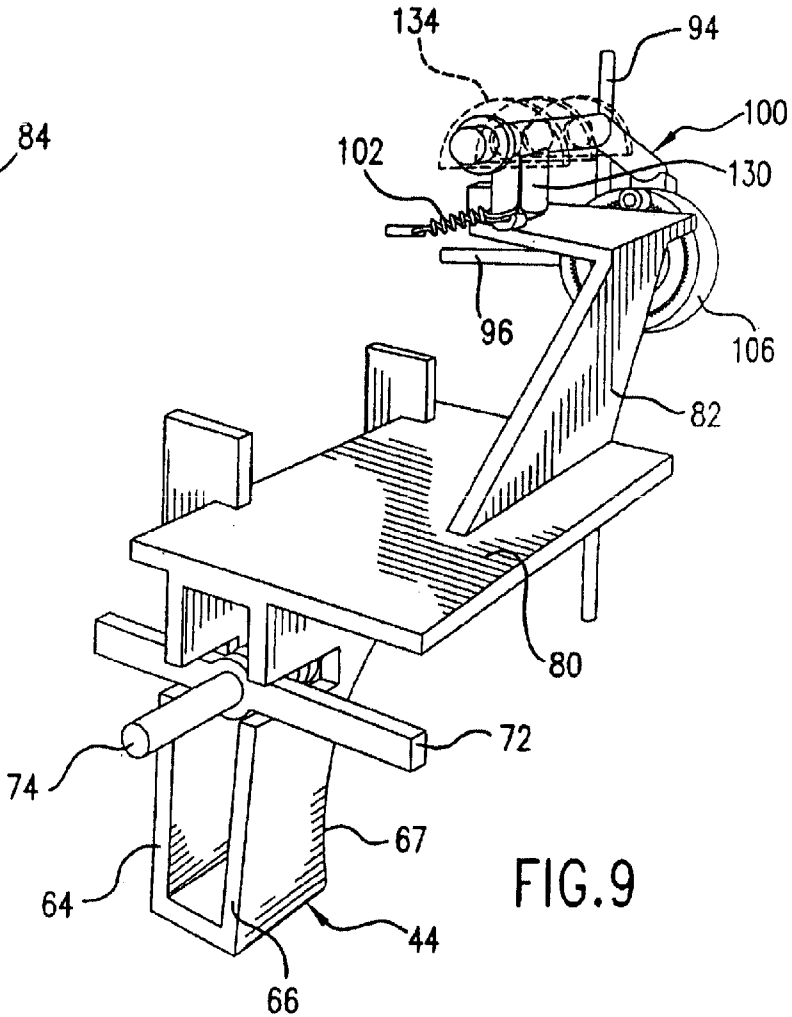
FIG. 9 is a top perspective view of the internal components of the assembly of FIG. 1 shown with the bubble ring in the actuated position and the air control system in a second position.
Figure 8:
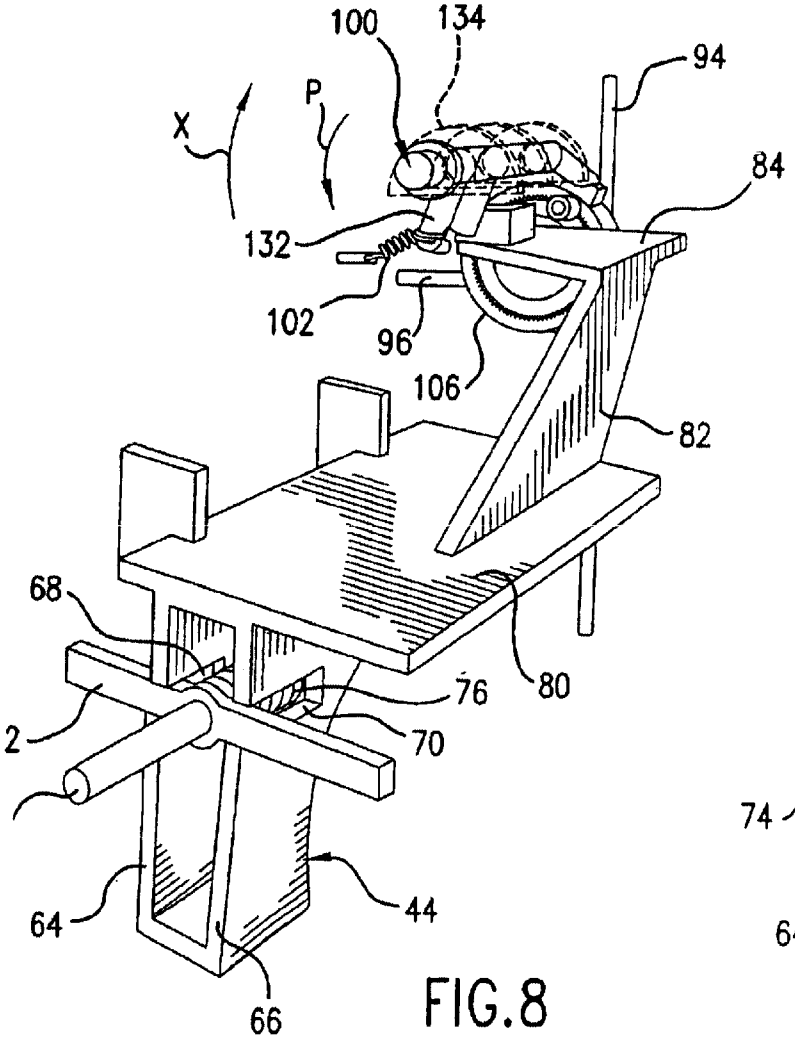
FIG. 8 is a top perspective view of the internal components of the assembly of FIG. 1 shown with the bubble ring in the normal position and the air control system in a first position.
Figure 10:
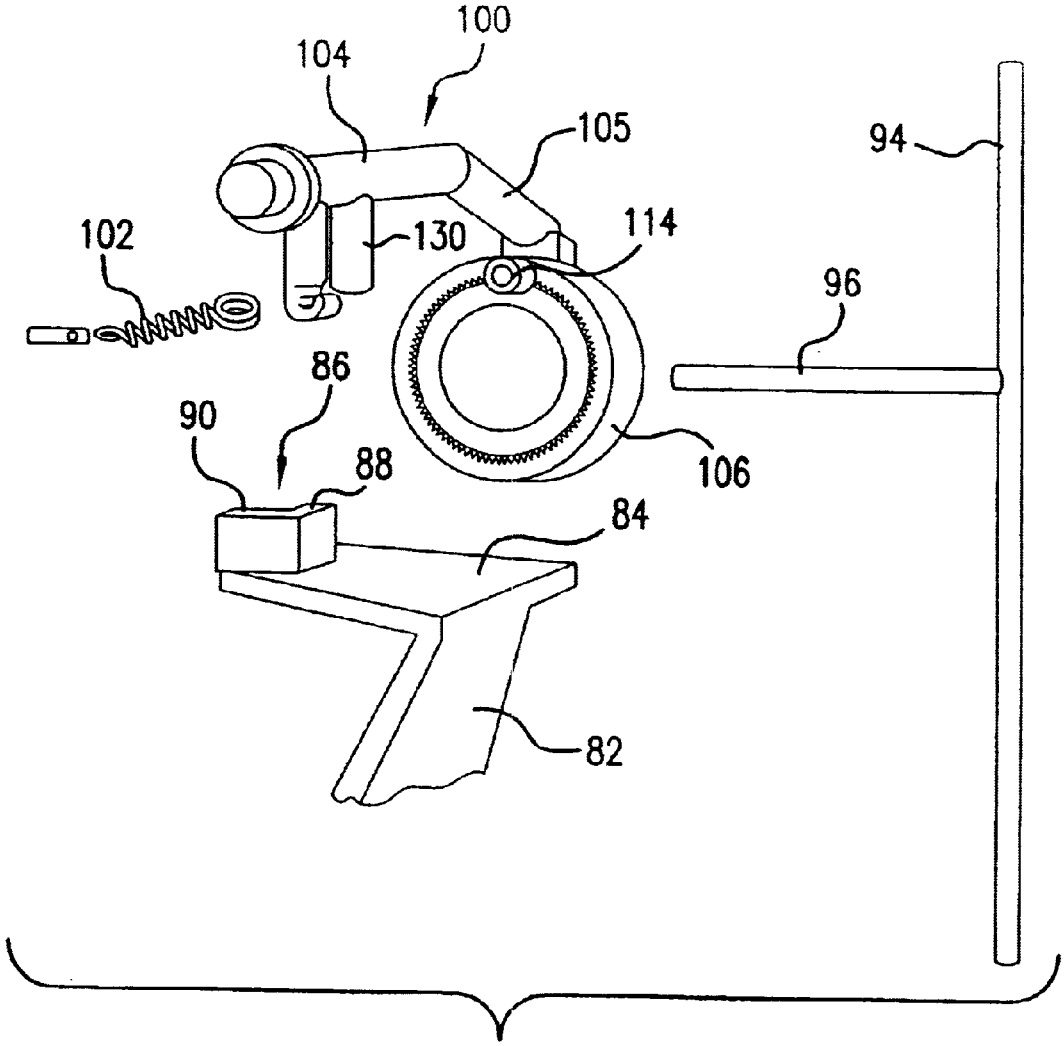
FIG. 10 is an exploded perspective view of the pump system of the assembly of FIG. 1.
Figure 16:
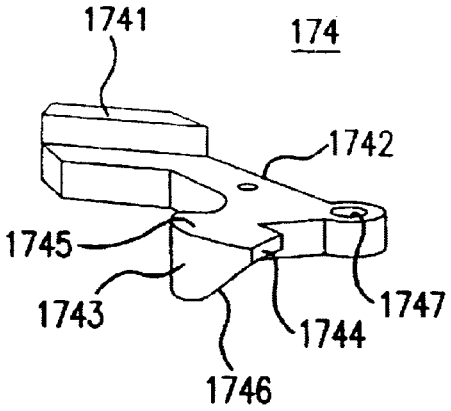
FIG. 16 is a perspective view of the valve element of the connector of the assembly of FIG. 1.

Referring to FIGS. 4, 5, 8, 9 and 15, a collection funnel 186 is positioned inside the housing 22 and below the location of the bubble ring 106. The collection funnel 186 can collect and receive droplets of bubble solution that have dripped from the bubble ring 106, and deliver these droplets of bubble solution back into the interior of the solution bottle 32. The cap-like connector 34 is fixedly secured to the housing 22 to define the receiving space 30. The bottle 32 can be threadably connected to, and disengaged from, the connector 34. The connector 34 has a first opening 352 through which the tubing 122 extends, and a second opening 353. The funnel 186 is fixedly attached (e.g., by welding, glue, etc.) to the top surface 354 of the cap 351. As shown in FIG. 5, a valve element 360 extends from the second opening 353. Referring to FIG. 16, the valve element 360 has a cylindrical body 362 with a shoulder 364 at its lower end. A bore 366 extends through the cylindrical body 362, and a ball 368 is retained inside the bore 366. The bottom wall 370 of the cylindrical body 362 has an elongated slit 372 which has a width that is smaller than the diameter of the ball 368. Therefore, as shown in FIG. 16, the ball 368 cannot pass through the slit 372, but can only be seated against the slit 372 in a manner that partially, but not completely, blocks the slit 372.

The cylindrical body 362 is attached to the second opening 353. In addition, the second opening 353 is smaller than the diameter of the ball 368 and the diameter of the bore 366, so that the ball 368 cannot pass through the second opening 353 to the interior of the funnel 186. Thus, when the assembly 20 is oriented in the orientation shown in FIGS. 1–3, the ball 368 will be seated at the bottom of the bore 366 against the slit 372, thereby allowing bubble solution collected by the funnel 186 to flow through the second opening 353, the bore 366, and the portions of slit 372 that are not blocked by the ball 368, back into the solution container 32. On the other hand, if the assembly 20 is inverted (i.e., turned upside down), the ball 368 will be abutted against the second opening 353, and will completely block the second opening 353, so that bubble solution from the solution container 32 can flow through the slit 372 and the bore 366, but cannot be spilled through the second opening 353 into the interior of the funnel 186.

Figure 17:
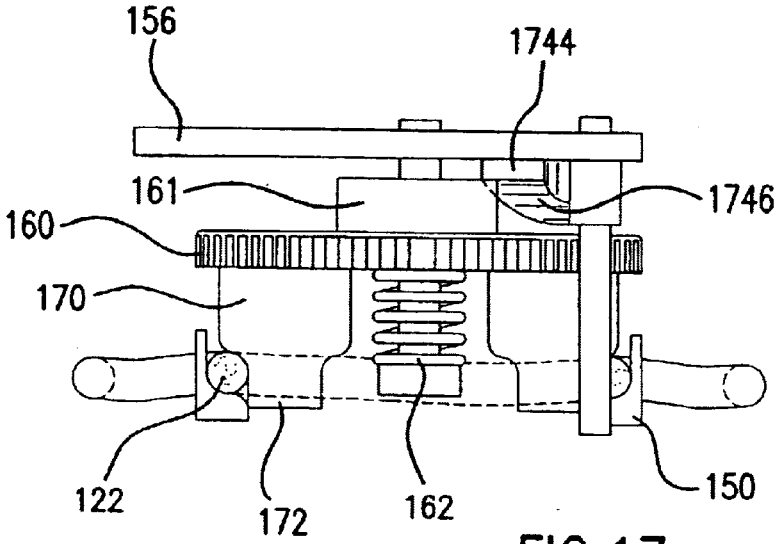
FIG. 17 illustrates the liquid trigger and pump of the bubble generating assembly of FIG. 1 in the non-use position.
Figure 18:
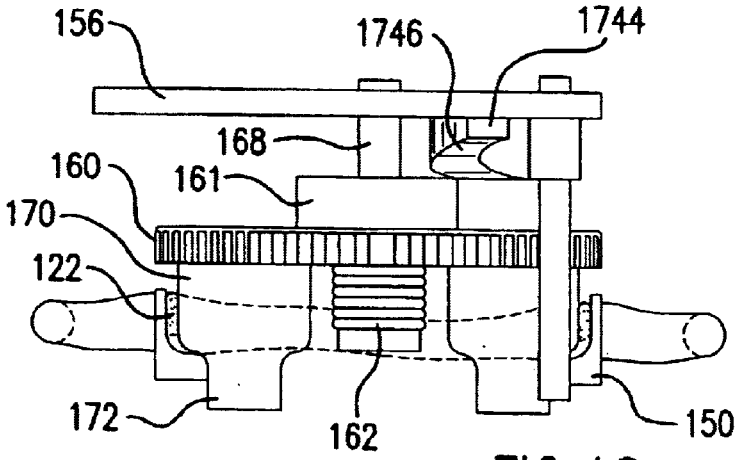
FIG. 18 illustrates the liquid trigger and pump of the bubble generating assembly of FIG. 1 in the bubble generating position.

The liquid generator is illustrated in FIGS. 17 and 18, and includes a pump 54 (described in greater detail below) that is housed in the handle section 24. The pump 54 has a piston 234 coupled to the bubble trigger 42, and a first tubing 238 that extends through the housing 22 into the bottle 33 for drawing the liquid (e.g., water) into the pump 54. The pump 54 further includes a second tubing 240 that extends through the barrel section 26 and is coupled to the nozzle 39. The bottle 33 is threadably connected to the connector 35 in the same manner that the bottle 32 is threadably connected to the connector 34, and the connectors 34 and 35 can have the same construction.

As shown in FIGS. 17 and 18, the pump 54 has a pump chamber 280 inside which is retained a spring 282. The piston 234 extends through an opening 284 in the chamber 280 and has a pusher surface 286 that is positioned adjacent one end of the spring 282. The chamber 280 also has an inlet 288 and an outlet 290. An inlet valve 292 is provided inside a receptacle 296 adjacent the inlet 288 and the tubing 238, and an outlet valve 294 is provided inside a receptacle 298 adjacent the outlet 290 and the tubing 240.

When the pump 54 is in the non-use position shown in FIG. 17, the withdrawal of the piston 234 in the direction of arrow FF creates a vacuum that draws liquid from the bottle 33 into the chamber 280. This occurs because the vacuum draws the inlet valve 292 towards the inlet 288 (compare FIGS. 17 and 18), to allow liquid to flow around the inlet valve 292 to enter the chamber 280. The vacuum also pulls the outlet valve 294 down to be seated over the outlet 290 to prevent liquid from exiting the chamber 280. When the user presses on the trigger 42, the piston 234 is depressed in the direction of arrow RR (see FIG. 18). This causes the piston 234 to compress the spring 282, creating a pressure that pushes the inlet valve 292 away from the inlet 288 in receptacle 296 to block liquid flow into the chamber 280. The pressure also pushes the liquid inside the chamber 280 out of the outlet 290, displacing the outlet valve 294 from the outlet 290, and causing the liquid to be delivered via the tubing 240 to the nozzle 39 for ejection. When the trigger 42 is released again, the spring load from the spring 282 will bias the piston 234 back in the forward direction of arrow FF, creating the vacuum to draw liquid into the chamber 280 again. Although FIGS. 17 and 18 illustrate one possible embodiment for the pump 54, it is possible to use any available pump.

The assembly 20 operates in the following manner. In the normal (non-bubble-generating) position, which is illustrated in FIGS. 2, 4, 6 and 8, the bubble ring 106 is positioned on one side (e.g., near the three o'clock position) of the front opening 38 on one side of the wiping bar 94. In this normal position, the resilient member 102 normally biases the pivot bar 100 towards one side of the housing 22 (see FIGS. 6 and 8), and the resilient member 76 normally biases the trigger 44 in the direction of the arrow F. At this time, the user can threadably secure the necks of the bottles 32 and 33 to the respective connectors 34 and 35 so that the assembly 20 is ready for use.

The assembly 20 is actuated by pressing the trigger 44 in the direction of the arrow R (see FIGS. 4 and 5) to overcome the natural bias of the resilient member 76, which causes three sequences of events occur at about the same time.

First, bubble solution is pumped to the bubble ring 106. In this regard, the rearward movement of the trigger 44 causes the electrical contact 60 to engage the motor 50, thereby forming a closed electrical circuit that will deliver power from the power source 48 to the motor 50. The motor 50 will turn on, thereby causing the motor gear 152 to drive and rotate the first and second gears 158 and 160. As the pressure rollers 164, 166 rotate, they will apply selected pressure on different parts of the tubing 122. FIGS. 12 and 13 illustrate this in greater detail. FIG. 12 illustrates the relationship between the pressure rollers 164,166 and the tubing 122 when the assembly 20 is in the normal non-bubble-generating condition, and FIG. 13 illustrates the relationship between the pressure rollers 164,166 and the tubing 122 when the assembly 20 is in the actuated (i.e., bubble-generating) position. As shown in FIG. 12, the tubing 122 is normally positioned between the bulbous section 170 of the pressure rollers 164,166 and the guide wall 150. The resilient element 162 normally biases the circular plate 155 towards the gear housing plate 175, and the circular plate 155 is positioned adjacent the bottom surface 1746 of the terminal tip 1744 of the slider 174. When the trigger 44 is pressed (se FIGS. 5 and 20), the trigger 44 pushes the angled front portion 1741 of the slider 174 in a clockwise direction (as viewed from the orientation of FIG. 20), overcoming the normal bias of the resilient element 176 and causing the slider 174 to pivot clockwise about the axis defined. by the shaft 178. As the slider 174 pivots, the curved piece 1743 pushes the circular plate 155 towards the guide wall 150 (see FIG. 13), causing the bulbous sections 170 of the pressure rollers 164, 166 to be pushed into the tubing 122 so that the tubing 122 is compressed against the guide wall 150. Thus, rotation of the pressure rollers 164, 166 will compress different portions of the tubing 122, thereby creating air pressure to draw the bubble solution from the interior of the solution bottle 32 through the tubing 122 into the chamber 112 of the bubble ring 106, where the bubble solution will bleed out through the outlets 118 on to the front surface 120 of the bubble ring 106.

This arrangement and structure of the pressure rollers 164, 166 is effective in prolonging the useful life of the tubing 122 and the pump system 61. In particular, the pressure rollers 164,166 (i.e., the bulbous sections 170) only apply pressure against the tubing 122 when the trigger 44 is pressed, so that the tubing 122 does not experience any pressure when the trigger 44 is not pressed. In other words, the bulbous sections 170 are positioned adjacent to, but do not compress, the tubing 122 when the trigger 44 is not pressed. This is to be contrasted with conventional pump systems used for pumping bubble solution to a bubble producing device, where pressure is always applied to the tubing regardless of whether the trigger is actuated. Over a long period of time, this constant pressure will deform the tubing, making it difficult for bubble solution to be drawn through the tubing.

Second, the bubble ring 106 will be moved from the position shown in FIG. 2, 4, 6 and 8 to a position on the other side of the front opening 38 (e.g., near the nine o'clock position), as shown in FIGS. 3, 5, 7 and 9. As best shown by comparing FIGS. 4, 6 and 8 with FIGS. 5, 7 and 9, respectively, when the trigger 44 is pressed in the direction of arrow R, the platform 80, vertical piece 82, and shelf 84 carried by the trigger 44 will also move in the same direction R. The guide bar 86 that is carried on the shelf 84 will also move in the same direction R. The guide leg 130 is normally biased by the resilient member 102 to be positioned at the rear of the angled guide bar 86 (see FIGS. 6 and 8). However, as the guide bar 86 moves in the direction R, the guide leg 130 is dragged along the angled surface of the guide bar 86 from the rear to the front of the guide bar 86. As the guide leg 130 travels along the angled surface of the guide bar 86 from the rear to the front, the pivot bar 100 is pushed by the guide bar 86 to be pivoted in the curved direction of the arrow P in FIG. 6 (counterclockwise if viewed from the rear of the pivot bar 100), which causes the bubble ring 106 to pivot in the same curved direction P. The curved direction P can approximate the shape of a semi-circle. As the bubble ring 106 pivots in this curved direction P, the bubble ring 106 will travel in a curved path as the front surface 120 of the bubble ring 106 wipes across the stationery wiping bar 94. The limit of the sliding motion of the guide leg 130 along the angled surface of the guide bar 86 is defined by the spring 102, which pulls the guide leg 130 back when the limit has been reached. At this point, the bubble ring 106 will have completed its curved path across the wiping bar 94 and will be positioned on the other side of the front opening 38, with the opening in the bubble ring 106 being completely clear of the wiping bar 94 and directly facing the open front end 196 of the wind tunnel 190. The wiping motion of the wiping bar 94 along the front surface 120 of the bubble ring 106 will generate a film of bubble solution (from the bubble droplets emitted from the outlets 118) that extends across the opening of the bubble ring 106.

Third, the air generator 188 that is secured to the motor 50 is actuated when the motor 50 is turned on. In this regard, the rearward movement of the trigger 44 causes the electrical contact 60 to engage the motor 50, thereby forming a closed electrical circuit that will deliver power from the power source 48 to the motor 50 to rotate the air generator 188. The air generator 188 blows a stream of air along the wind tunnel 190 towards the bubble ring 106. This stream of air will then travel through the film of bubble solution that has been formed over the bubble ring 106, thereby creating bubbles. The amount of air blown by the air generator 188 through the wind tunnel 190 can be adjusted by manipulating the air control system in the manner described above.

Thus, pressing the trigger 44 will create a film of bubble solution across the bubble ring 106 by (i) pumping bubble solution from the solution bottle 32 to the bubble ring 106, and (ii) and causing the bubble ring 106 to be moved across the wiping bar 94 to the center of the front opening 38 so that bubbles can be created. Pressing the trigger 44 will also actuate the air generator 188 to blow streams of air at the bubble ring 106 to create bubbles 18.

Once the bubbles 18 have been created, the user can then actuate the other trigger 42 to cause a stream of liquid 19 (e.g., water) to be ejected from the nozzle 39. The stream of liquid 19 can be aimed at the bubbles 18 to pop the bubbles 18. Thus, when the user presses the trigger 42 in the direction of arrow R, the liquid generator is actuated in the manner described above to draw liquid from the liquid bottle 33 through the tubing 238, the pump 54 and the tubing 240 to be ejected via the nozzle 39. By placing the triggers 42, 44 side-by-side, the user can actually press both triggers 42, 44 simultaneously with different fingers of the same hand.

When the user releases his or her pressing grip on the trigger 44, the resilient member 76 will normally bias the trigger 44 back in the direction F, causing three events to occur.

First, this will cause the electrical contact 60 carried on the trigger 44 to be biased away from the motor 50 so that the electrical circuit is opened, thereby cutting power to the motor 50. As a result, the air generator 188 will stop producing streams of air. This is the first event.

The second event is that the pump system 61 will stop drawing bubble solution from the solution bottle 32 to the bubble ring 106. This occurs because power to the motor 50 has been cut so that the gears 152,158 and 160 stop rotating, and because the bias of the trigger 44 back in the direction F will cause the pushing end surface 45 of the trigger 44 to disengage the front portion 1741 of the slider 174. As a result, the resilient member 176 will bias front portion 1741 of the slider 174 to move the slider 174 in a counterclockwise direction (as viewed from the orientation of FIG. 19), so that the curved piece 1743 of the slider 174 will move from the position shown in FIGS. 13 and 20 back to the normal (non-bubble-generating) position shown in FIGS. 12 and 19. This movement of the curved piece 1743 allows the normal bias of the resilient member 162 to push the circular plate 155 towards the gear housing plate 175 as the circular plate 155 slides along the bottom surface 1746 of the curved piece 1743. As the circular plate 155 moves towards the gear housing plate 175, the pressure applied by the pressure rollers 164, 166 on the tubing 122 will be released, as shown in FIG. 12.

In the third event, the movement of the trigger 44 in the direction F will also cause the platform 80, the vertical piece 82, the shelf 84 and the guide bar 86 to move in the direction F. As the guide bar 86 moves in the direction F, the normal bias of the resilient member 102 will cause the guide leg 130 to be dragged along the angled surface of the guide bar 86 from the front to the rear thereof. As the guide leg 130 travels along the angled surface of the guide bar 86 from the front to the rear thereof, the bias of the resilient member 102 will pivot the pivot bar 100 to be pivoted in the curved direction X (which can also approximate a semi-circular shape) that is opposite to the arrow P in FIG. 6 (clockwise if viewed from the rear of the pivot bar 100), which causes the bubble ring 106 to pivot in the same curved direction X. As the bubble ring 106 pivots in this opposite curved direction X, the bubble ring 106 will travel in a curved path as the front surface 120 of the bubble ring 106 wipes across the stationery wiping bar 94, back to the normal (non-bubble-generating) position shown in FIGS. 2, 4, 6 and 8.

In addition, the collection funnel 186 is positioned directly below the bubble ring 106 to collect any stray droplets of bubble solution that drip from the bubble ring 106. These stray droplets can flow back into the solution bottle 32 via the collection funnel 186 and the valve element 360. In addition, the solution bottle 32 can be removed from the housing 22 by threadably disengaging the neck of the solution bottle 32 from the connecting section 34, so as to replenish or replace the supply of bubble solution.

Similarly, when the user releases his or her pressing grip on the liquid trigger 42, the resilient member 282 will normally bias the piston 234 and the trigger 42 back in the direction F, as described above. The liquid bottle 33 can be removed from the housing 22 by threadably disengaging the neck of the bottle 33 from the connector 35, so as to replenish or replace the supply of the liquid.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:

a housing having a front opening, with a bubble generating ring and a nozzle positioned adjacent the front opening;

a first container coupled to the housing and retaining bubble solution, the first container having an interior;

a second container coupled to the housing and retaining a liquid, the second container having an interior;

a first trigger;

a second trigger positioned next to the first trigger so that a user can simultaneously actuate the first and second triggers with the same hand;

a first tubing that couples the interior of the first container with the ring;

a second tubing that couples the interior of the second container with the nozzle;

a link assembly that couples the first trigger and the ring in a manner in which actuation of the first trigger causes bubbles to be formed by the ring; and a liquid generator that couples the second trigger and the nozzle in a manner in which actuation of the second trigger causes liquid from the second container to be ejected from the nozzle.

2. The assembly of claim 1, further including:

a motor operatively coupled to the first trigger;

an air generator coupled to the motor and directing air towards the ring; and a gear system coupled to the motor and applying pressure to the first tubing to cause bubble solution to be delivered from the first container to the ring.

3. The assembly of claim 2, wherein actuation of the first trigger simultaneously causes (i) the air generator to direct air towards the ring, (ii) the gear system to deliver bubble solution from the first container to the ring, and (iii) a film of bubble solution to be formed across the ring.

4. The assembly of claim 1, further including means for drawing bubble solution from the container, and to deliver the bubble solution to the ring.

5. The assembly of claim 4, wherein the drawing means includes the first trigger, at least one rotating pressure roller and a guide wall, the pressure roller having a bulbous section, with the first tubing compressed by the bulbous section of the pressure roller and the guide wall when the first trigger is actuated.

6. The assembly of claim 1, wherein the first and second containers are removably coupled to the housing.

7. The assembly of claim 1, wherein the ring is positioned inside the housing.

8. The assembly of claim 1, wherein the air generator includes a fan, and a wind tunnel that extends from the fan to adjacent the front opening.

9. The assembly of claim 1, further including a collection funnel positioned below the ring, with the first container being removably coupled to the collection funnel so that droplets received on the collection funnel can flow into the first container.

10. The assembly of claim 1, wherein the ring has an interior chamber and an opening communicating with the interior chamber and through which the first tubing extends, and a plurality of outlets on the front surface through which bubble solution can flow out.

11. The assembly of claim 2, wherein the first trigger has an electrical contact that removably couples the motor to actuate the motor, and a resilient member that normally biases the electrical contact away from the motor.

12. The assembly of claim 1, wherein the link assembly includes:

a link element connected to the first trigger;

a guide bar positioned on the link element, the guide bar having a guide surface;

a pivot bar pivotably coupled to the housing, the pivot bar having a front end that is attached to the ring, and a guide leg that slidably engages the guide surface;

a resilient member coupled to the pivot bar and normally biasing the pivot bar to pivot in a first direction; and wherein actuation of the trigger mechanism causes the guide leg to slide along the guide surface to overcome the bias of the resilient member, so that the pivot bar pivots in a second direction.

13. The assembly of claim 12, further including:

a wiping bar secured to a permanent location extending across a portion of the front opening, and wherein the ring moves across the wiping bar when the pivot bar pivots in the first and second directions.

14. The assembly of claim 13, wherein the ring experiences a curved movement as the ring moves across the wiping bar.

15. The assembly of claim 1, further including an air control system that has a cover element which is adjusted to cover selected portions of the air generator to vary the amount of air provided to the air generator.

16. The assembly of claim 13, wherein the ring experiences a semi-circular movement as the ring moves across the wiping bar.

17. The assembly of claim 12, wherein the guide surface is angled.

18. A bubble generating assembly comprising:

a housing having a front opening, with a bubble generating ring and a nozzle positioned adjacent the front opening;

a first container coupled to the housing and retaining bubble solution, the first container having an interior;

a second container coupled to the housing and positioned next to the first container, the second container having an interior that retains a liquid;

a first trigger;

a second trigger;

a first tubing that couples the interior of the first container with the ring;

a second tubing that couples the interior of the second container with the nozzle;

a link assembly that couples the first trigger and the ring in a manner in which actuation of the first trigger causes bubbles to be formed by the ring; and a liquid generator that couples the second trigger and the nozzle in a manner in which actuation of the second trigger causes liquid from the second container to be ejected from the nozzle.

19. The assembly of claim 18, wherein the second trigger is positioned next to the first trigger so that a user can simultaneously actuate the first and second triggers with the same hand.

20. The assembly of claim 18, wherein the first and second containers are removably coupled to the housing.

* * * * *

UNITED STATES PATENT AND TRADEMARK OFFICE

CERTIFICATE OF CORRECTION

PATENT NO. : 6,682,570 B2
DATED : January 27, 2004
INVENTOR(S) : Thai

It is certified that error appears in the above-identified patent and that said Letters Patent is hereby corrected as shown below:

Delete Title page illustrating figure, and substitute therefor new Title page illustrating figure. (attached)

Delete drawing sheets 1-9, and substitute therefor drawing sheets 1-9, as shown on the attached sheet.

Signed and Sealed this

Twenty-fourth Day of August, 2004

JON W. DUDAS
*Director of the United States Patent and Trademark Office*

(12) United States Patent
Thai

(10) Patent No.: US 6,682,570 B2
(45) Date of Patent: Jan. 27, 2004

(54) BUBBLE GENERATING ASSEMBLY

(75) Inventor: Douglas Thai, Walnut, CA (US)

(73) Assignee: Arko Development Limited (HK)

( * ) Notice: Subject to any disclaimer, the term of this patent is extended or adjusted under 35 U.S.C. 154(b) by 0 days.

(21) Appl. No.: 10/444,561

(22) Filed: May 23, 2003

(65) Prior Publication Data

US 2003/0199221 A1 Oct. 23, 2003

Related U.S. Application Data

(63) Continuation-in-part of application No. 10/247,994, filed on Sep. 20, 2002, which is a continuation-in-part of application No. 10/195,816, filed on Jul. 15, 2002, which is a continuation-in-part of application No. 10/133,195, filed on Apr. 26, 2002, which is a continuation-in-part of application No. 10/099,431, filed on Mar. 15, 2002.

(51) Int. Cl.[7] ..... A63H 33/28
(52) U.S. Cl. ..... 446/15; 446/484
(58) Field of Search ..... 446/15–21, 484, 446/483, 267, 176

(56) References Cited

U.S. PATENT DOCUMENTS

| | | | | |
|---|---|---|---|---|
| 2,560,582 A | | 7/1951 | Limber | |
| 2,659,177 A | | 11/1953 | Kopf | |
| 2,974,438 A | | 3/1961 | Hopkins | |
| 3,579,898 A | | 5/1971 | Hein | |
| 3,604,144 A | | 9/1971 | Span | |
| 4,423,565 A | * | 1/1984 | Bart | 46/8 |
| 4,700,965 A | | 10/1987 | Kinberg | |
| 4,957,464 A | | 9/1990 | Perez | |
| 5,395,274 A | | 3/1995 | Myers | |
| 5,462,469 A | | 10/1995 | Lei | |
| 5,498,191 A | | 3/1996 | DeMars | |
| 5,520,564 A | | 5/1996 | DeMars | |
| 5,542,869 A | | 8/1996 | Petty | |
| 5,613,890 A | | 3/1997 | DeMars | |
| 5,879,218 A | | 3/1999 | Tao | |
| 5,975,358 A | * | 11/1999 | Zheng et al. | 222/79 |
| 6,062,935 A | | 5/2000 | Gross | |
| 6,149,486 A | | 11/2000 | Thai | |
| 6,200,184 B1 | | 3/2001 | Rich et al. | |
| 6,315,627 B1 | | 11/2001 | Thai | |
| 6,331,130 B1 | | 12/2001 | Thai | |

* cited by examiner

*Primary Examiner*—Jacob K Ackun
*Assistant Examiner*—Jamila Williams
(74) *Attorney, Agent, or Firm*—Raymond Sun

(57) ABSTRACT

A bubble generating assembly has a housing having a front opening, with a bubble generating ring and a nozzle positioned adjacent the front opening. The assembly has a first container coupled to the housing and retaining bubble solution, and a second container coupled to the housing and retaining a liquid (e.g., water). The first and second containers can be positioned next to each other. The assembly also has a first trigger, and a second trigger positioned next to the first trigger so that a user can simultaneously actuate the first and second triggers.

20 Claims, 12 Drawing Sheets

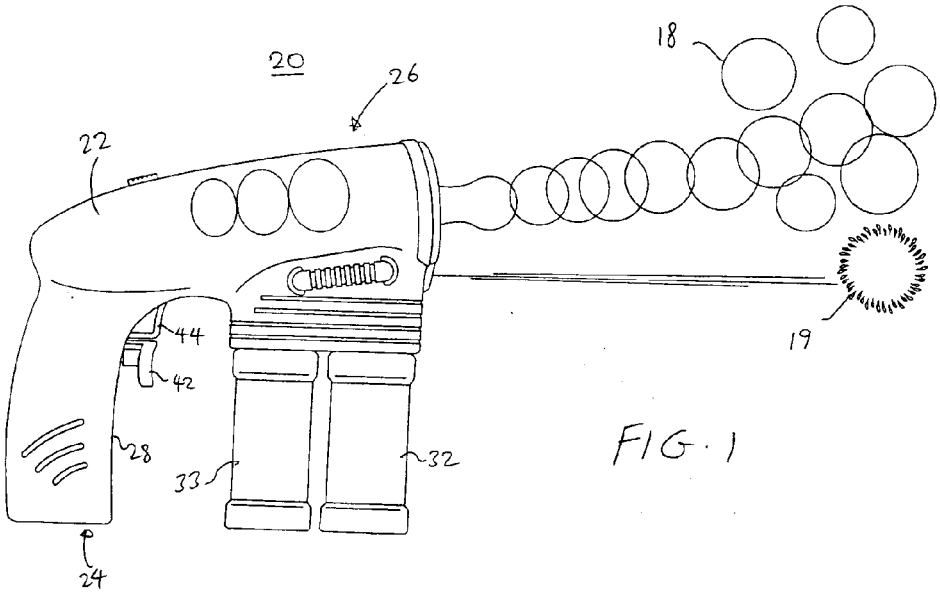

FIG. 1